US008944039B2

(12) United States Patent
Larmer et al.

(10) Patent No.: US 8,944,039 B2
(45) Date of Patent: Feb. 3, 2015

(54) PAINTBALL MARKER

(71) Applicant: Dye Precision, Inc., San Diego, CA (US)

(72) Inventors: Kevin Patrick Larmer, San Marcos, CA (US); Gerald R. Parks, Chula Vista, CA (US); Ming-Chuan Chen, Dongshan Township, Yilan County (TW)

(73) Assignee: Dye Precision, Inc., San Diego, CA (US)

( * ) Notice: Subject to any disclaimer, the term of this patent is extended or adjusted under 35 U.S.C. 154(b) by 0 days.

(21) Appl. No.: 13/648,239

(22) Filed: Oct. 9, 2012

(65) Prior Publication Data

US 2014/0096757 A1 Apr. 10, 2014

(51) Int. Cl.
*F41B 11/72* (2013.01)
*F41B 11/00* (2013.01)
*F41B 11/52* (2013.01)

(52) U.S. Cl.
CPC ..... *F41B 11/00* (2013.01); *F41B 11/52* (2013.01)
USPC ..... 124/73; 124/45

(58) Field of Classification Search
CPC ..... F41B 11/72; F41B 11/50–11/52; F41B 11/62
USPC ..... 124/48–49, 72–77
See application file for complete search history.

(56) References Cited

U.S. PATENT DOCUMENTS 5,265,582 A * 11/1993 Bhogal ..... 124/73
5,280,778 A * 1/1994 Kotsiopoulos ..... 124/73
5,494,024 A * 2/1996 Scott ..... 124/73
5,669,369 A * 9/1997 Scott ..... 124/73
6,055,975 A * 5/2000 Gallagher et al. ..... 124/50
6,233,928 B1 * 5/2001 Scott ..... 60/407
6,418,920 B1 * 7/2002 Marr ..... 124/74
6,561,176 B1 * 5/2003 Fujimoto et al. ..... 124/76
6,644,294 B2 * 11/2003 Christensen ..... 124/77
6,729,321 B2 * 5/2004 Ho ..... 124/49
6,732,726 B2 * 5/2004 Ho ..... 124/74
6,742,512 B1 * 6/2004 Ho et al. ..... 124/49
6,923,170 B2 * 8/2005 Ho et al. ..... 124/49
6,932,031 B2 * 8/2005 Adams ..... 123/46 R
6,935,324 B2 * 8/2005 Watson et al. ..... 124/49
7,302,944 B2 * 12/2007 Judson ..... 124/83
7,318,428 B2 * 1/2008 Ho ..... 124/49
7,322,347 B2 * 1/2008 Broersma ..... 124/49
7,353,815 B2 * 4/2008 Wei ..... 124/45
7,686,005 B2 * 3/2010 Adams ..... 124/77
7,770,571 B2 * 8/2010 Tippmann et al. ..... 124/73
7,775,199 B2 * 8/2010 Ho ..... 124/49
7,779,825 B2 * 8/2010 Estrate ..... 124/49
7,921,837 B2 * 4/2011 Dobbins et al. ..... 124/71
8,074,632 B2 * 12/2011 Dobbins ..... 124/77
8,113,189 B2 * 2/2012 Dobbins et al. ..... 124/71
8,176,908 B2 * 5/2012 Dobbins ..... 124/73

(Continued)

*Primary Examiner* — Michael David

(74) *Attorney, Agent, or Firm* — Knobbe Martens Olson & Bear LLP

(57) ABSTRACT

A pneumatic paintball marker has, for example, a feed system for receiving paintballs from paintball containers having different outlets. The feed system includes a lever and a drive system. The drive system defines an opening through the marker and into the breech. Actuation of the lever moves the opening between at least two positions. The breech receives paintballs from one of the containers when in the first position and from the other paintball container when in the second position.

13 Claims, 22 Drawing Sheets

(56) References Cited

U.S. PATENT DOCUMENTS

| | | | | |
|---|---|---|---|---|
| 8,210,159 | B1 * | 7/2012 | Neumaster et al. | 124/51.1 |
| 8,505,525 | B2 * | 8/2013 | Dobbins et al. | 124/71 |
| 8,534,272 | B2 * | 9/2013 | Dobbins | 124/75 |
| 8,555,868 | B2 * | 10/2013 | Dobbins | 124/73 |
| 8,573,191 | B2 * | 11/2013 | Dobbins | 124/73 |
| 2005/0103317 | A1 * | 5/2005 | Watson et al. | 124/45 |
| 2008/0053422 | A1 * | 3/2008 | Estrate | 124/49 |
| 2012/0060811 | A1 * | 3/2012 | Macy | 124/51.1 |
| 2012/0125304 | A1 * | 5/2012 | Brooks et al. | 124/52 |
| 2013/0047481 | A1 * | 2/2013 | Macy et al. | 42/49.01 |
| 2013/0180513 | A1 * | 7/2013 | Foeller | 124/62 |
| 2014/0096755 | A1 * | 4/2014 | Larmer et al. | 124/52 |
| 2014/0130787 | A1 * | 5/2014 | Macy | 124/73 |

* cited by examiner

PAINTBALL MARKER

BACKGROUND

1. Field of the Invention

The present invention relates to pneumatic guns. More specifically, this invention relates to a paintball marker.

2. Description of the Related Art

This invention relates to pneumatic paintball markers, which typically are used for target practice and in mock war games. The markers use a compressed gas, such as air or nitrogen, to propel spherical projectiles called paintballs out of the barrel of the device. Paintballs are typically comprised of a colored liquid enclosed in a fragile gelatin casing. The paintballs are designed to rupture upon impact to mark the target.

In the sport known as "Paintball", the spherical projectiles containing colored liquid are fired at an opponent and burst upon contact so that the colored liquid is deposited on the opponent scoring a hit for the combatant. All the participants involved in the sport are required to wear an abundance of protective gear, so that the paintballs cannot hit vital parts of the player's anatomy.

A hopper is usually attached to a top surface of the marker for holding paintballs. The hopper and marker share a common passageway by which paintballs pass from the hopper to the breech of the paintball marker. In this way paintballs can be continuously fed to the marker using gravity while playing the sport of paintball. A drawback to having a hopper located on the top of the marker is the hopper can impair the combatant's view during play as well as provide a conspicuous target for the other team or opposing combatants to shoot even when the player's body is hidden from view.

The sport of paintball has become very popular within a relatively short period of time, but there is still a need for a pneumatic paintball marker with improved features.

SUMMARY OF THE INVENTION

In view of the foregoing, a need exists for an improved pneumatic marker.

An aspect of the invention is directed to a pneumatic marker configured to fire a paintball. The pneumatic paintball marker comprises a body member in the shape of a rifle and that has a longitudinal bore. The marker further comprises a barrel extending from said body member and in flow communication with the longitudinal bore and a sleeve disposed in the longitudinal bore of the body member and defining a breech. A side wall of the sleeve has an opening for paintballs to enter the breech. The opening is rotatable relative to the body member between at least a first position and a second position.

Another aspect is directed a pneumatic paintball marker configured to fire a paintball. The pneumatic paintball marker comprises a body member having a first portion and a second portion defining a longitudinal bore having a breech. The second portion has a side wall with an opening for paintballs to enter the breech. The opening is rotatable relative to the first portion between at least a first position and a second position. The marker further includes a barrel coupled to the body member and in flow communication with the longitudinal bore.

Another aspect is directed to a pneumatic paintball marker configured to fire a paintball. The pneumatic paintball marker comprises a body member having a longitudinal bore and a pneumatic bolt assembly disposed in a portion of the longitudinal bore and movable between a loading position and a firing position. The marker further comprises an opening disposed in a wall of the body member and in front of the pneumatic bolt assembly at least when the pneumatic bolt assembly is in the loading position. The opening is movable between a first position and a second position. The opening is configured to receive paintballs from an outlet of a first paintball container when in the first position and from an outlet of a second paintball container when in the second position. The outlet for the second paintball container is in a different relative location than an outlet for the first paintball container.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional paintball markers.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

The following detailed description is now directed to certain specific embodiments of the invention. In this description, reference is made to the drawings wherein like parts are designated with like numerals throughout the description and the drawings.

Figure 1:
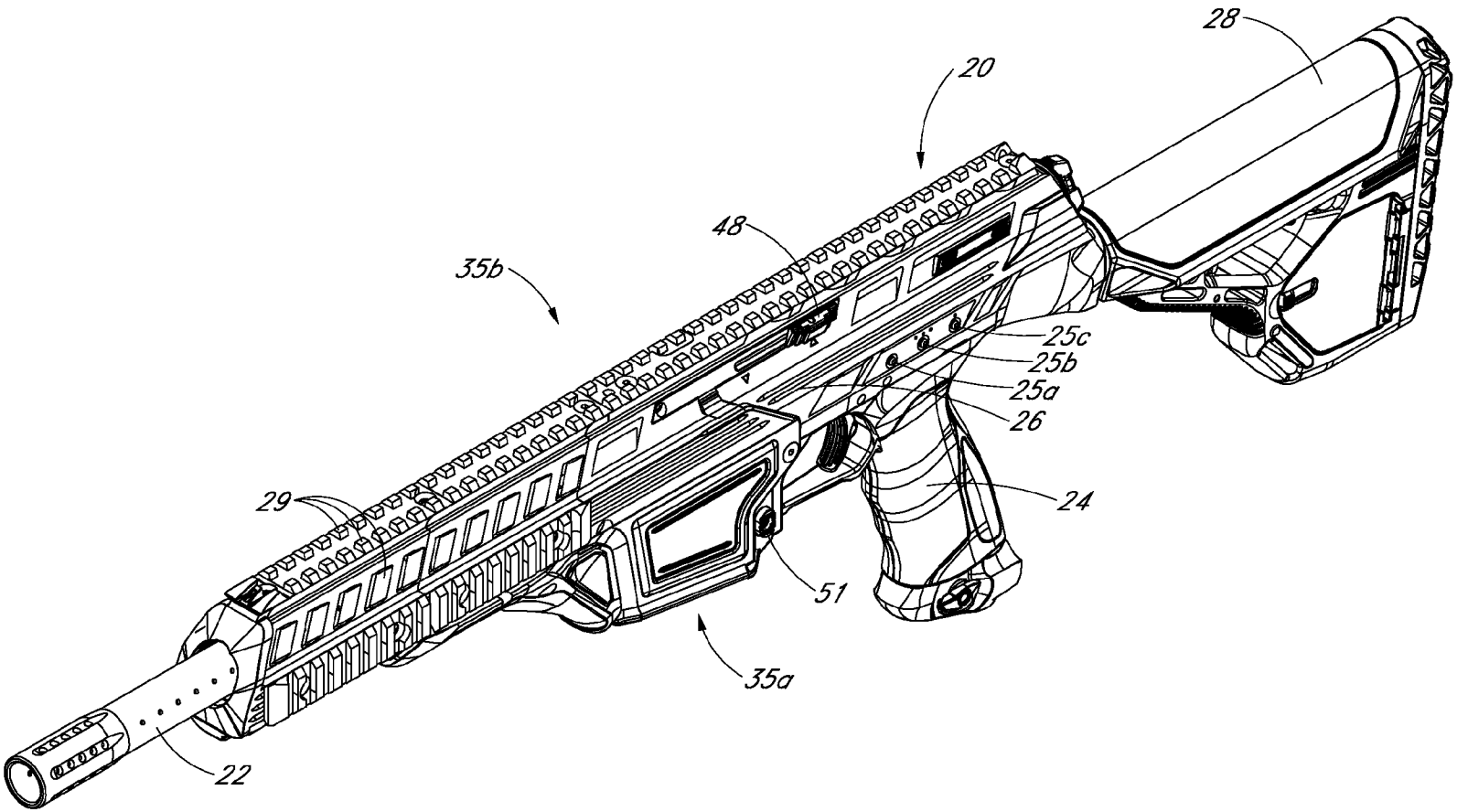
FIG. 1 depicts a perspective view of a pneumatic paintball marker accordingly to one embodiment of the present invention that includes a selective feed system which allows paintballs to selectively enter a breech of the marker through a first opening or a second opening.

FIG. 1 depicts a perspective view of a pneumatic paintball marker 20 accordingly to one embodiment of the present invention that includes a selective feed system. The selective feed system allows paintballs to enter the breech of the marker 20 from at least two different openings 35(*a*), 35(*b*). The view generally shows the left side of the pneumatic paintball marker 20. For example, a first opening 35(*a*) is different from a second opening 35(*b*) if the second opening 35(*b*) is at a different radial clocking than the first opening 35(*a*) with respect to the longitudinal axis of the marker 20 and/or if the second opening 35(*b*) is at a different location than the first opening 35(*a*) along the longitudinal axis of the marker 20. In the illustrated embodiment, the first and second openings 35(*a*), 35(*b*) have the same location along the longitudinal axis but are clocked at different radial locations about the longitudinal axis of the marker 20. For example, in certain embodiments the first opening 35(*a*) is clocked at the 6 o'clock position and the second opening 35(*b*) is clocked at the 2 o'clock position.

While the locations of the first and second openings 35(*a*), 35(*b*) are different, the structure(s) that forms the openings need not be. For example, at least some of the structure which defines the passageway from the first opening 35(*a*) into the breech could slide or rotate to a different position to define some or all of the passageway from the second opening 35(*b*) into the breech. In this way, some or all of the structure which defines the first opening 35(*a*) also defines at least some of the second opening 35(*b*). Alternatively, the structure forming the passageway from the second opening 35(*b*) is different from the structure forming the passageway from the first opening 35(*a*). In such an embodiment, the first and second openings 35(*a*), 35(*b*) into the breech of the marker 20 can be open at the same time or one can be selectively closed or opened by, for example, covering one of the two openings with a plate or other similar structure. In the illustrated embodiment, the passageways from the first and second openings 35(*a*), 35(*b*) share at least some structure. The shared structure rotates between the different locations to define the first and second openings 35(*a*), 35(*b*). In this way, the marker 20 can include a single opening which moves between two locations.

For embodiments where at least some structure slides or rotates to define the first and second openings 35(*a*), 35(*b*), the marker 20 can include a mechanical or electrical switch which moves the shared structure between the different positions when activated. The switch can be activated directly or indirectly by a user. For example, indirect activation can occur when a user engages a magazine or other paintball storage container with the marker 20. The mechanical engagement between the magazine and other paintball storage container can trigger the marker 20 to switch between the first and second openings 35(*a*), 35(*b*). Indirect activation can occur when a user moves or holds the marker 20 in a predetermined orientation. In such an embodiment, for example, an accelerometer could provide input to a motor which selects between the first and second openings 35(*a*), 35(*b*). The accelerometer senses the movement of the marker 20 and sends an electrical signal to the motor to slide or rotate structure to open or close the first and second openings 35(*a*), 35(*b*).

Direct activation can occur when a user presses a button or moves a switch to select between the first and second openings 35(*a*), 35(*b*). For example, a switch can be positioned on the buttstock of the marker 20 to contact the user's shoulder. In the illustrated embodiment, the user slides a lever to select between the first and second openings 35(*a*), 35(*b*). More specifically, when the lever is slid an internal structure rotates between the first and second openings 35(*a*), 35(*b*). Thus, in the illustrated embodiment, some or all of the structure defining the passageway from the first opening 35(*a*) into the breech of the marker 20 also defines at least some of the passageway from the second opening 35(*b*) into the breech of the marker 20. In this way, the marker 20 can include a single movable opening.

Figure 2:
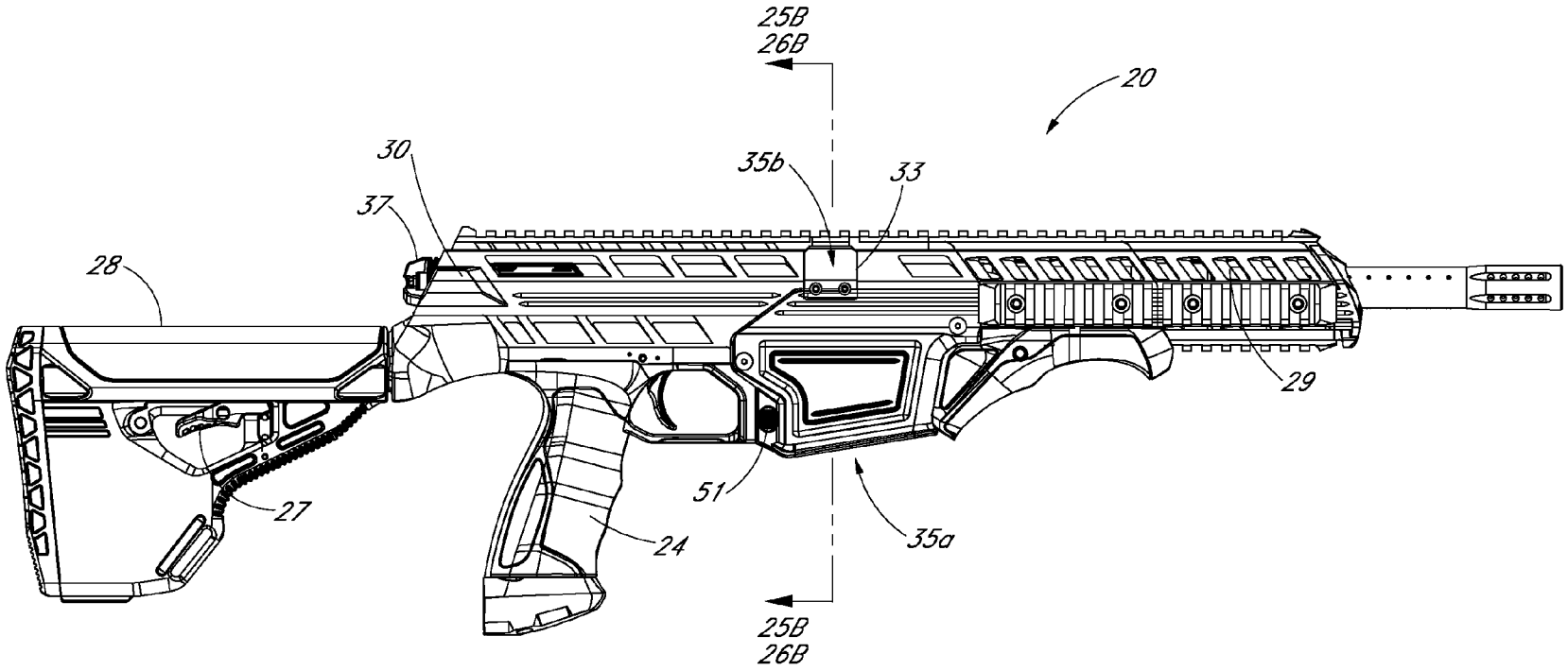
FIG. 2 is a right side view of the pneumatic paintball marker from FIG. 1 showing a removable plate located over a second opening into the breech.

FIG. 2 is a right side view of the pneumatic paintball marker 20 from FIG. 1. The marker 20 includes a removable plate 33 which covers the second opening 35(*b*) into the breech. One or more fasteners can be used to secure and remove the plate 33 from the marker 20. In certain configurations, with the plate 33 removed the user is able to remove one or more internal components of the marker 20.

Figure 3:
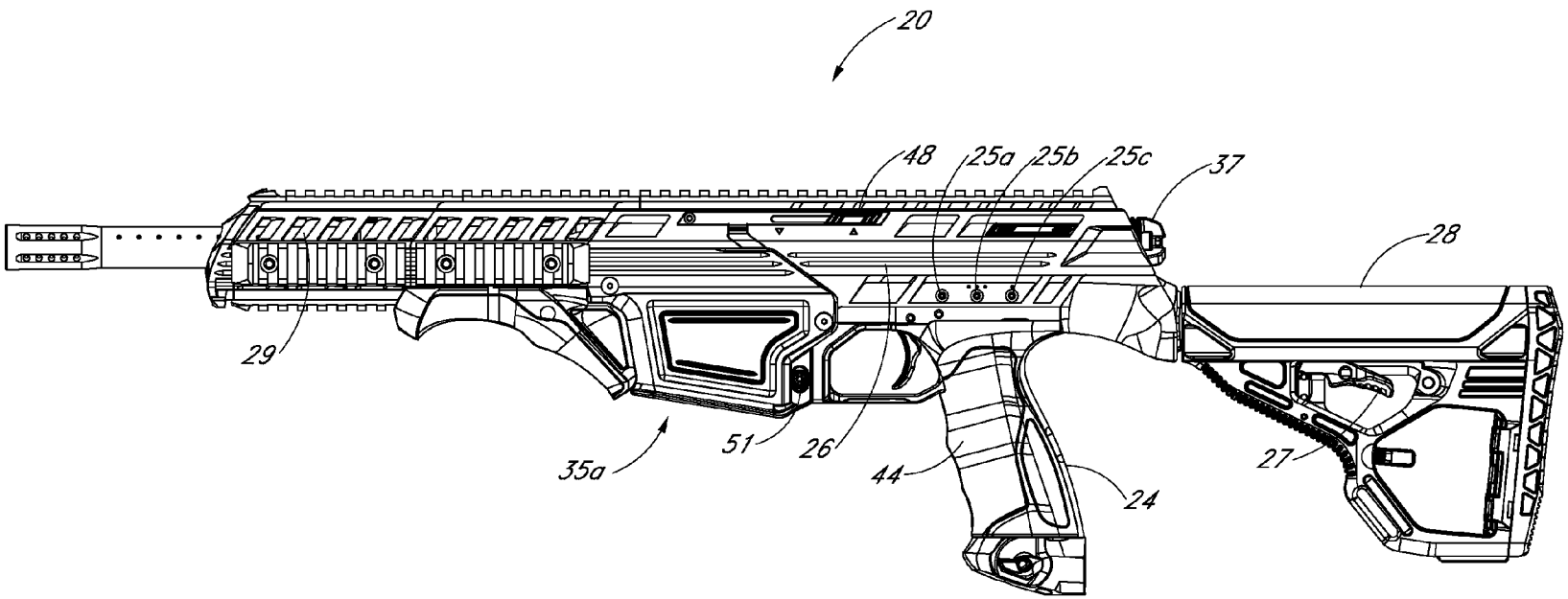
FIG. 3 is a left side view of the pneumatic paintball marker from FIG. 1.

FIG. 3 is a left side view of the pneumatic paintball marker 20 from FIG. 1. The pneumatic paintball marker 20 includes a body 26, a handgrip frame 24, and a buttstock 28. A barrel 22 is located at the front of the body 26. The marker 20 is generally rifle-shaped, and in one embodiment the body 26 is manufactured as a single metal piece with a computer numerically controlled ("CNC") machine.

At least a portion of a bolt assembly 36 (see FIG. 8A) reciprocates within the body 26 generally along the longitudinal axis of the barrel 22 and between forward and back positions. The marker 20 further includes a longitudinal bore which houses the reciprocating bolt assembly 36. The bore continues through the barrel 22 and out a muzzle end. A portion of the bore, called a breech, is located in front of the bolt assembly 36 and receives paintballs to be fired. The paintballs can enter the breech through more than one opening 35(*a*), 35(*b*). In the illustrated embodiment, the marker 20 includes two openings. Of the course the disclosure is not limited to two openings and the marker 20 can include additional openings. The marker 20 further includes one or more rails 29 which surround portions of the body 26 and/or barrel 22. At least a portion of the one or more rails 29 may be a Picatinny rail.

Figure 4:
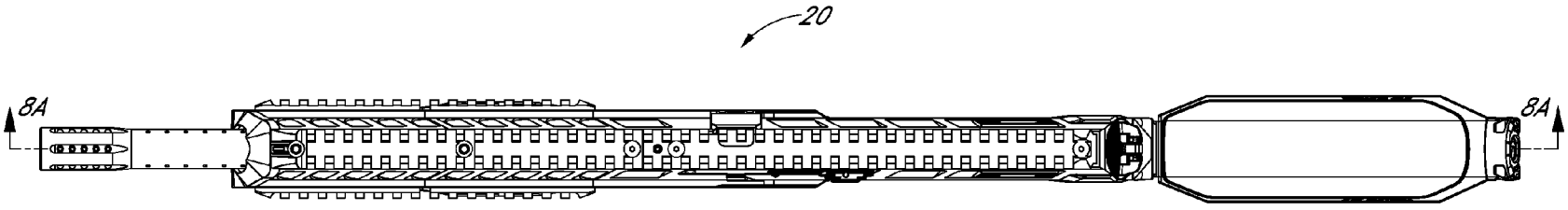
FIG. 4 is a top side view of the pneumatic paintball marker from FIG. 1.
Figure 5:
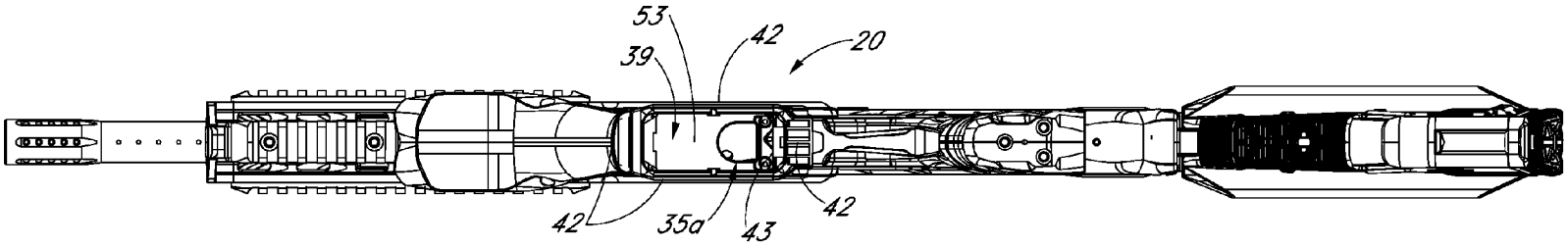
FIG. 5 is a bottom side view of the pneumatic paintball marker from FIG. 1 showing a first opening into the breech.

FIG. 4 is a top side view of the pneumatic paintball marker 20 from FIG. 1. FIG. 5 is a bottom side view of the pneumatic paintball marker 20 from FIG. 1 showing a first opening 35(*a*) into a breech or paintball loading chamber of the marker 20.

The marker 20 further includes a receptacle 39 disposed on a bottom surface of the marker 20. The receptacle 39 includes one or more walls 42 which surround the first opening 35(*a*) into the breech. The receptacle 39 is configured to receive a portion of a magazine 90 as is most clearly shown in FIG. 28. The walls 42 are sized and shaped to firmly engage with an outer surface of the received portion of the magazine 90 so as to maintain alignment between the magazine 90 and the first opening 35(*a*) for paintballs to pass from the magazine 90 to the breech.

Figure 6:
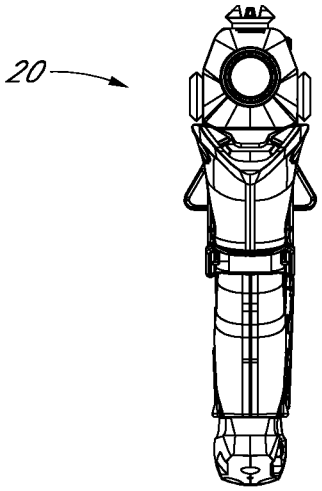
FIG. 6 is a front view of the pneumatic paintball marker from FIG. 1.
Figure 7:
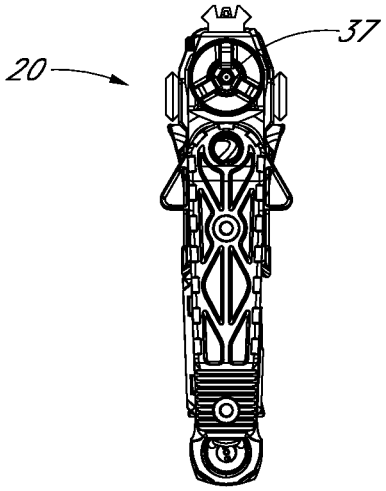
FIG. 7 is a rear view of the pneumatic paintball marker from FIG. 1.

FIG. 6 is a front view of the pneumatic paintball marker 20 from FIG. 1. FIG. 7 is a rear view of the pneumatic paintball marker 20 from FIG. 1. At the back of the body 26 is an exposed rear portion or cap 37. The rear cap 37 closes an opening in the back of the marker 20. In certain embodiments, the rear cap 37, a bolt assembly 36, and a regulator 30 together form an assembly. As most clearly shown in FIG. 8A, the bolt assembly 36 and regulator 30 are accessible from the outside of the paintball marker 20 through the opening covered by the cap 37 in the body 26. At least a portion of the bolt assembly 36 and/or regulator 30 is fastened to the opening in the body 26 by, for example, a threaded connection. Consequently, the bolt assembly 36 and regulator 30 can be removed as a single piece by unscrewing the rear cap 37 from the opening. The bolt assembly 36 and regulator 30 are installed into the body 26 by sliding the bolt assembly 36 and regulator 30 into the back of the body 26. Once installed, the bolt assembly 36 and regulator 30 are disposed above the handgrip frame 24.

A portion of the rear cap 37 is magnetically adhered to the bolt assembly 36 and regulator 30. A user can overcome the magnetic force and retract the portion from the regulator 30 to create a lever or grip region for the user to then rotate the entire bolt assembly 36 and regulator 30 without tools. The bolt assembly 36 within the body 26 includes a translating bolt 110 that moves during operation of the paintball marker 20.

Figure 8A:
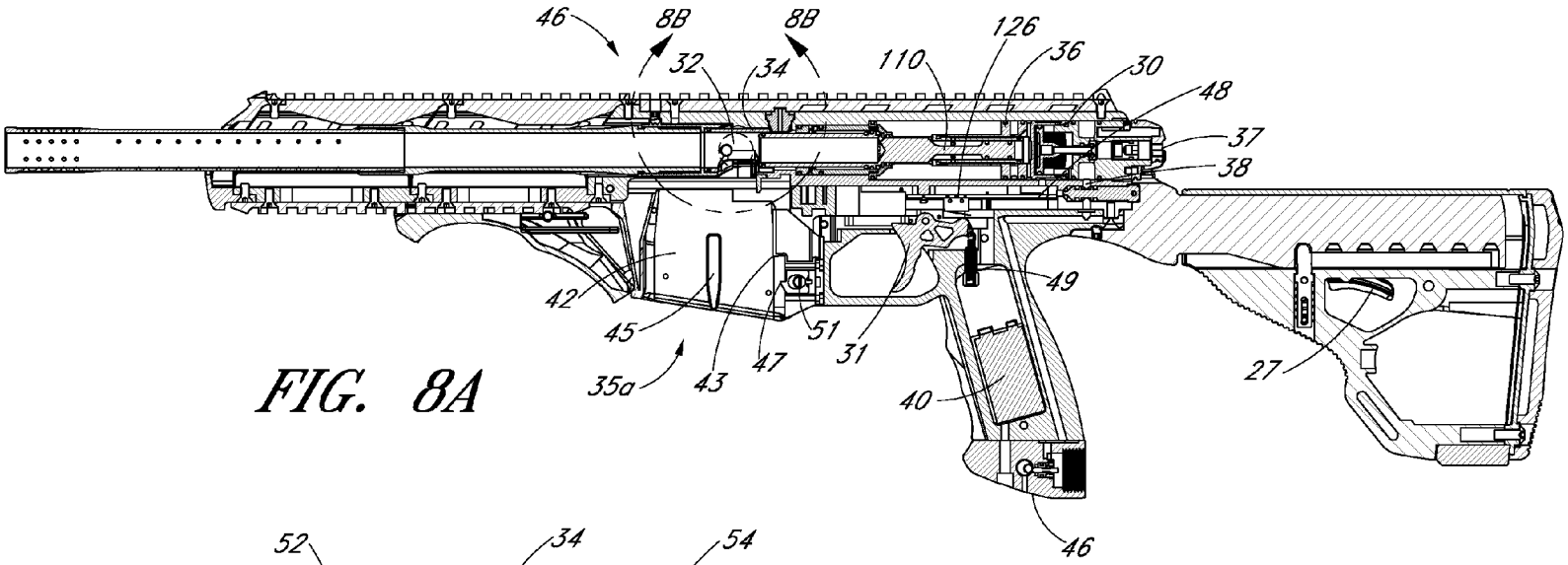
FIG. 8A is a cross-section through the center of the pneumatic paintball marker of FIG. 4 with the sleeve of the feed system rotated to the first or 6 o'clock position to allow paintballs to enter the breech through the first opening.

FIG. 8A is a cross-section through the center of the pneumatic paintball marker 20 of FIG. 4 with a sleeve 34 of a feed system 46 rotated to the first or 6 o'clock position to allow paintballs to enter the paintball loading chamber or breech 32 through the first opening 35(*a*). At the back of the body 26 is an air supply passage 38. The air supply passage 38 routes air through the handgrip frame 24 and to the regulator 30. As explained above, in certain embodiments, the regulator 30 is combined with the bolt assembly 36 and is located at the rear of the bolt assembly 36. In the illustrated embodiment, the air supply passage 38 supplies air to the bolt assembly 36 at two locations along the length of the body 26.

Referring to FIG. 8A, the walls 42 can include one or more rails 45 disposed on an inner surface for receiving corresponding grooves in the casing of the magazine. A width of the rail 45 can be narrower near the opening into the receptacle 39 and then increase in width in a direction towards the first opening 35(*a*). In this way, only coarse alignment of the magazine with the marker 20 is required to initially engage the magazine with the marker 20. As the magazine is further engaged with the marker 20, the increasing width of the rails 45 guides the magazine to a more precise alignment with the marker 20 to feed paintballs to the marker 20.

Figure 8B:
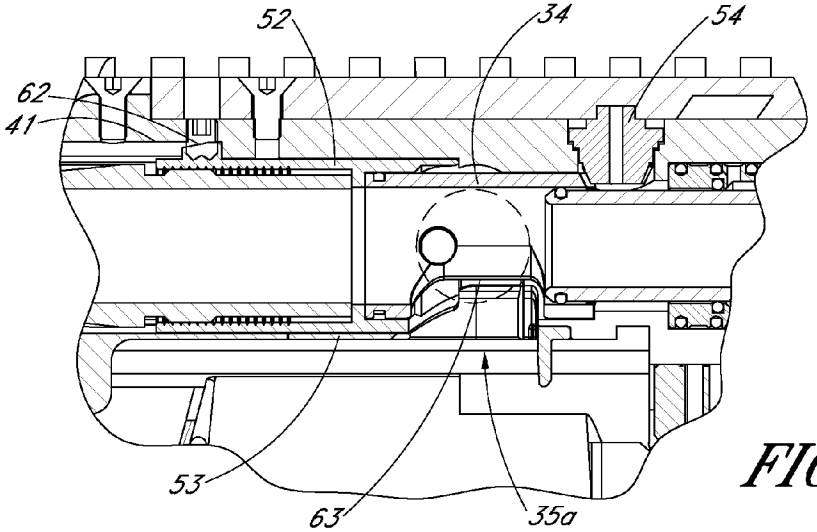
FIG. 8B is an enlarged view of the feed system from FIG. 8A.
Figure 8C:
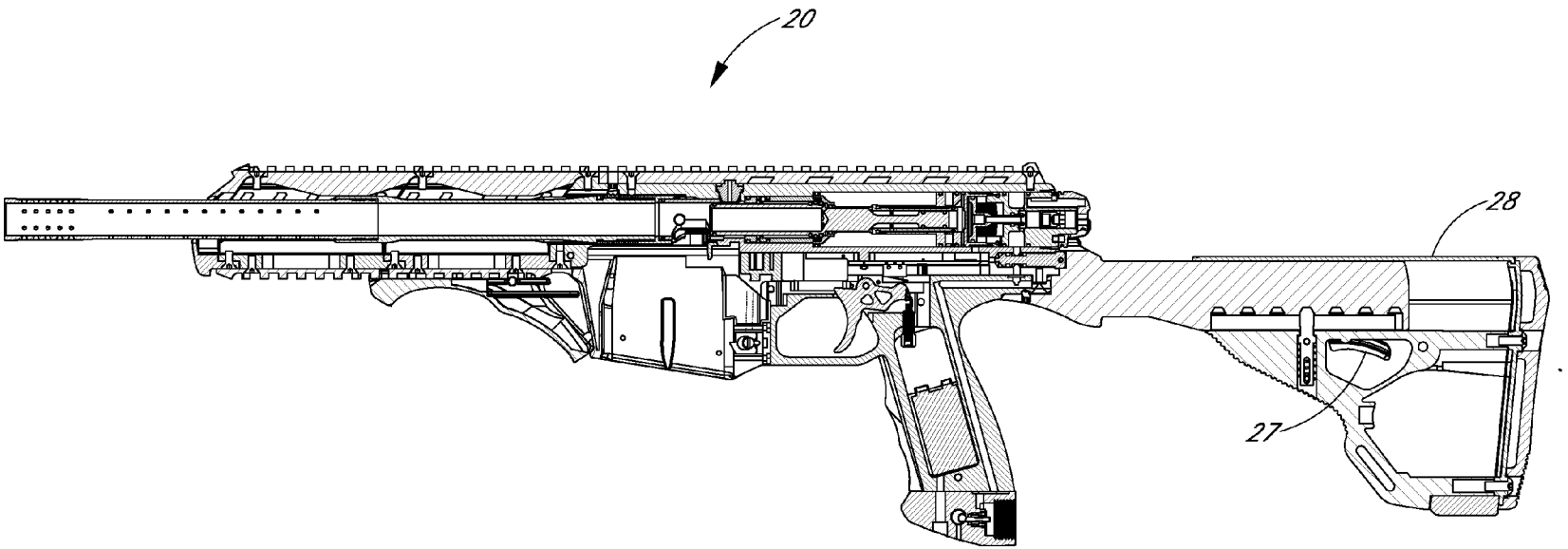
FIG. 8C is a view similar to FIG. 8A except the buttstock has been moved to the extended position.
Figure 8E:
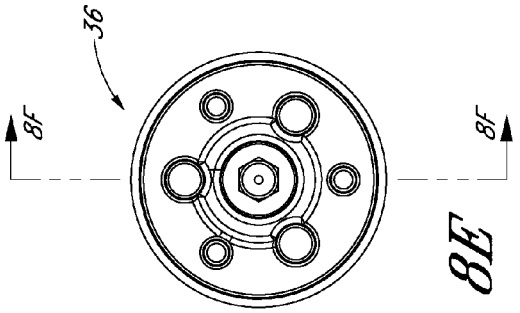
FIG. 8E is a rear end view of the bolt assembly and regulator from FIG. 8D.
Figure 8D:
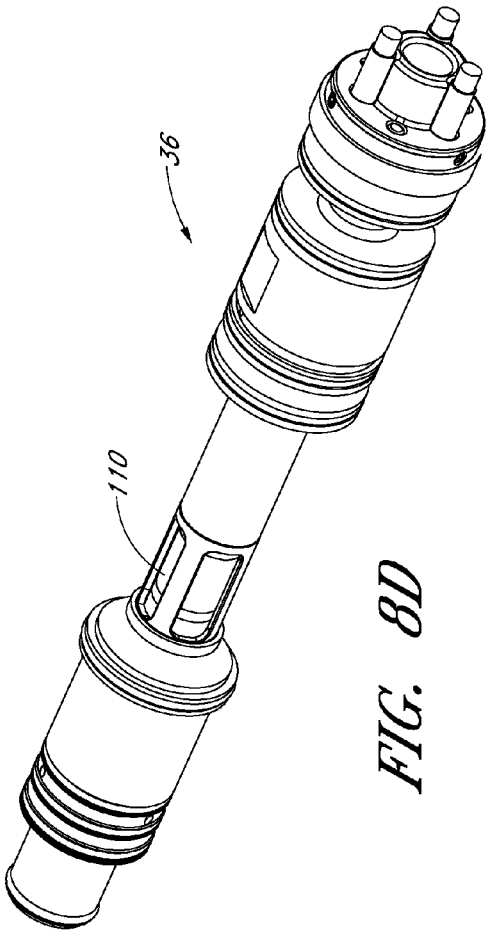
FIG. 8D is a perspective view of the bolt assembly and regulator from FIG. 8A.
Figure 8F:
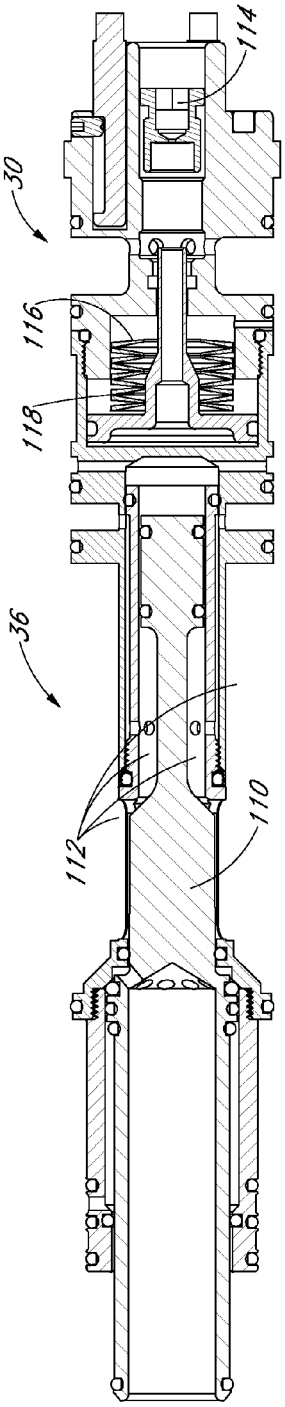
FIG. 8F is a cross-section through the bolt assembly and regulator along lines 8F-8F in FIG. 8E.

The bolt assembly 36 comprises a bolt 110. FIG. 8D is a perspective view of the bolt assembly 36 and regulator 30 from FIG. 8A. The rear cap 37 has been removed from the regulator 30. FIG. 8E is a rear end view of the bolt assembly 36 and regulator 30 from FIG. 8D. FIG. 8F is a cross-section through the bolt assembly 36 and regulator along lines 8F-8F in FIG. 8E. A supply of air is routed to the middle of the bolt assembly 36 through the air supply passage 38 into a bolt firing chamber 112. The air passing through the bolt firing chamber 112 is responsible for propelling the paintball out of the barrel 22. A second supply of air is routed to a front portion of the bolt assembly 36 and eventually to a solenoid. The firing sequence is initiated via the solenoid. Exemplary bolt assemblies 36 for use with the marker 20 are also fully described in U.S. Pat. No. 7,594,503 and U.S. Patent Application Publication No. 2008/0099005, which are both expressly incorporated by reference as if fully set forth herein.

Referring to FIG. 8A, the handgrip frame 24 is located below the body 26. The handgrip frame 24 and body 26 preferably houses the electronics of the pneumatic paintball marker 20. For example, the electronics are arranged on a circuit board 48 and further include a power source. The circuit board 48 can be housed in the body 36. The electronics may include, for example, an arrangement of resistors, capacitors, and transistors which supply a signal to a processor running software and which is located on the circuit board 48 in the body 26. The processor receives at least data coming from an anti-chop eye system to determine whether the paintball is correctly positioned within the breech 32. An exemplary anti-chop eye system for use with the marker 20 is also fully described in U.S. Pat. No. 7,765,998, which is expressly incorporated by reference as if fully set forth herein. The electronics control operational aspects of the paintball marker 20. For example, the electronics inhibit the pneumatic paintball marker 20 from breaking the paintballs within the marker by not allowing the pneumatic paintball marker 20 to fire until a paintball is fully seated in the paintball loading chamber or breech 32 in front of the bolt assembly 36.

Power is supplied to the pneumatic paintball marker 20 by a battery 40 or capacitor housed within the handgrip frame 24. A common power source for the electronics is preferably employed.

The handgrip frame 24 may be made from a combination of plastic and metal materials. Further, different types of plastics may be used for the handgrip frame 24. For example, the handgrip frame 24 may principally comprise a combination of Nylon and glass fibers.

The handgrip frame 24 includes a trigger 31 for the pneumatic paintball marker 20. In certain embodiments the trigger 31 comprises a higher grip outer surface material molded to a base trigger structure. The outer surface material and the rear surface of the handgrip frame 24 may comprise a softer material, such as, for example, a thermo plastic elastomer (TPE). The forward and over travels of the trigger 31 are user adjustable. A spring 49 biases the trigger 31 in a downward direction so as to rotate the trigger 31 away from a micro switch 126. Signals from the micro switch 126 control operation of the solenoid.

The handgrip frame 24 may be enclosed on the sides and front by a grip cover 44. The grip cover 44 may comprise urethane, plastic, or the like. The grip cover 44 may comprise a combination of materials, for example, a poly propylene base and a thermo plastic elastomer (TPE) outer surface.

As most clearly shown in FIG. 3, the body 26 includes an on/off switch 25(*a*), a mode switch 25(*b*), and an anti-chop eyes system switch 25(*c*). A user changes the status of the marker 20 between on and off by pressing the on/off switch 25(*a*). The mode switch 25(*b*) changes the rate of fire for the marker 20. For example, successive activations of the mode switch 25(*b*) can cycle the marker 20 between a semi-automatic rate of fire, a burst mode rate of fire, and a fully automatic rate of fire. In one embodiment, the number of paintballs shot when in burst mode is three. In other embodiments, the circuit board 48 is programmed to file more than three paintballs when in burst mode. One or more status indicator lamps provide a visual indication of the marker 20 settings.

In certain embodiments, the buttstock 28 is releasably attached to rear portions of the handgrip frame 24 and body 26. Alternatively, the buttstock 28 is slid to one or more extended positions. The user is able to adjust the distance between the back of the buttstock 28 and the handgrip frame 24 by selecting one of the extended positions. The user unlocks the buttstock 28 from the body 26 via lever 37. Once the desired position is selected, the user releases the latch 37 to lock the buttstock 28 in the selected position. An extended position of the buttstock 28 is illustrated in FIG. 8C.

Surfaces of the buttstock 28 may be covered by an anti-slip material, and have waterproofing properties. Both the rear of the handgrip frame 24 and the rear of the body 26 interlock via interengaging structure. The interengaging structure may include an adhesive, fasteners, or other structure.

As most clearly shown in FIG. 8F, the pneumatic paintball marker 20 includes a pressure regulator 30. The pressure regulator 30 is disposed behind the bolt assembly 36. The regulator 30 receives high pressure gas, such as air or nitrogen, supplied to the pneumatic paintball marker 20. A wide variety of compressed gasses will work equally well within the pneumatic paintball marker 20 as well as compressed air are all covered within the scope of this patent, although references within this patent will be made to compressed air only.

The output pressure of the pressure regulator 30 is adjusted by turning a metal air regulating screw 114 located inside the rear cap 37. By turning the air regulating screw 114 counterclockwise, a user will increase the output pressure of the pressure regulator 30 to the pneumatic paintball marker 20. By turning the air regulating screw 114 clockwise, the user will decrease the output pressure of the pressure regulator 30 to the pneumatic paintball marker 20. High-pressure compressed air is supplied to the pressure regulator 30 at the air fitting 46 at the base (see FIG. 8A). In one embodiment, the in-line pressure regulator 30 adjusts the pressure of the compressed gas within a 350-3100 kPa range.

The regulator 30 uses an imbalanced design that fills a primary chamber behind a piston 118 that is opposed by a shim stack or spring 116 when the pressure behind the piston 118 is great enough to overcome the spring 116, the passage way is blocked by the tip of the piston 118 contacting the regulator seat. The pressure that is required to overcome the spring 116 is the operating pressure and determines the volume of air release to the atmosphere.

Referring back to FIG. 8A, the barrel 22 may be a one-piece or two-piece type barrel. The barrel 22 is threaded into the front of the body 26 of the pneumatic paintball marker 20. The body 26 includes a paintball loading chamber or breech 32 located between the bolt assembly 36 and the attachment location to the barrel 22.

In certain embodiments, the paintball loading chamber 32 selectively receives paintballs from more than one opening 35(*a*), 35(*b*) into the breech 32. For example, a sleeve 34 can include an opening 63 in a wall of the sleeve 34. A user can rotate the sleeve 34 and its opening 63 between the first opening 35(*a*) in the bottom of the marker 20 and the second opening 35(*b*) in the side of the marker 20. As is illustrated in FIG. 8A, the opening 63 in the sleeve 34 is aligned with the first opening 35(*a*) when the sleeve 34 is rotated to the 6 o'clock or first position. Similarly, the opening 63 is aligned with the second opening 35(*b*) when the sleeve 34 is rotated to the 2 o'clock or second position.

While the first and second openings 35(*a*), 35(*b*) are illustrated as being located at the 6 and 2 o'clock positions for ease of description, respectively, the locations of the first and second openings 35(*a*), 35(*b*) are not limited to the listed locations and can be located at any clocking as well as at any location along the longitudinal axis of the marker 20. In the illustrated embodiment, the same structure, such as the opening 63, partially defines the passageway into the breech 32 from both openings 35(*a*), 35(*b*). In this way, the marker 20 can include a common structure 34 which moves between the two positions or locations of the openings 35(*a*), 35(*b*).

Figure 10:
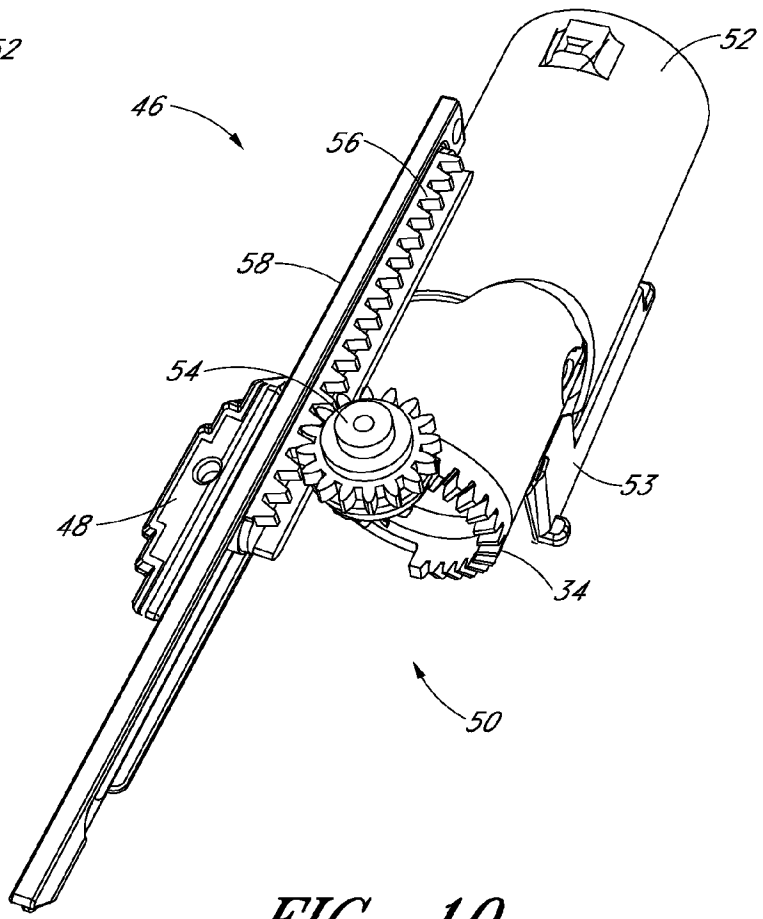
FIG. 10 is a perspective view of the feed system from FIG. 9 after the sleeve has been rotated in a clockwise direction to the first position to allow paintballs to enter the breech from a magazine.
Figure 9:
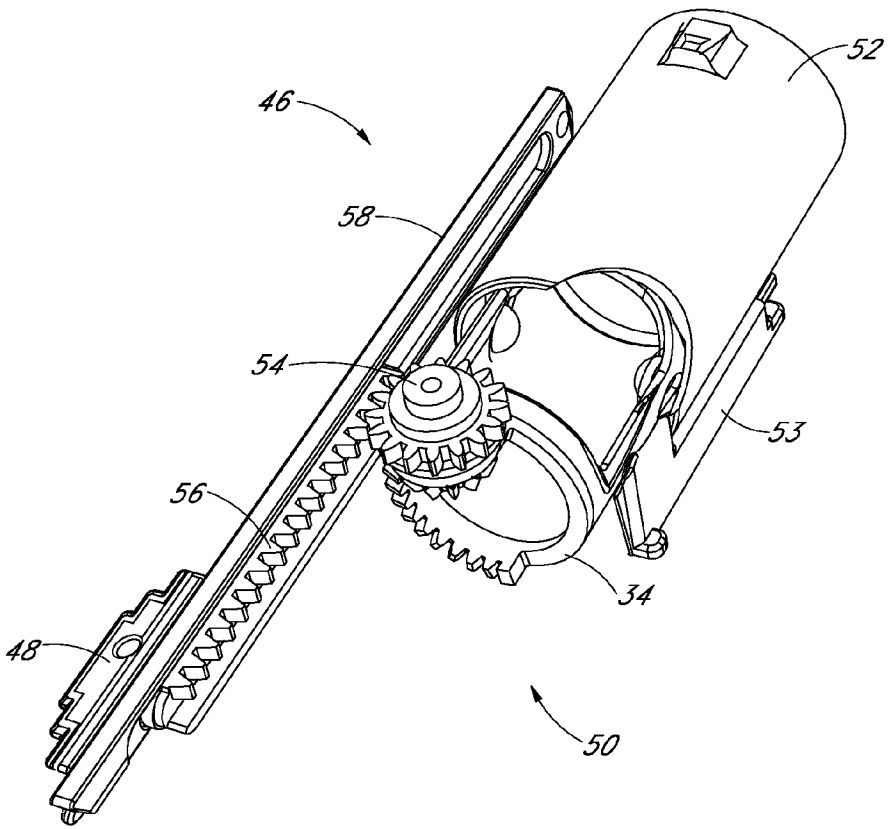
FIG. 9 is a perspective view of the feed system from FIG. 8A showing the sleeve rotated to the second position to receive paintballs from a hopper.

FIG. 9 is a perspective view of the feed system 46 from FIG. 8A showing the feed system 46 with the sleeve 34 rotated so that the opening 63 in the sleeve 34 is aligned with the second opening 35(*b*) in the side of the marker 20. FIG. 10 is a perspective view of the feed system 46 from FIG. 9 with the sleeve 34 rotated so that the opening 63 in the sleeve 34 is aligned with the first opening 35(*a*) in the bottom of the marker 20.

Figure 11:
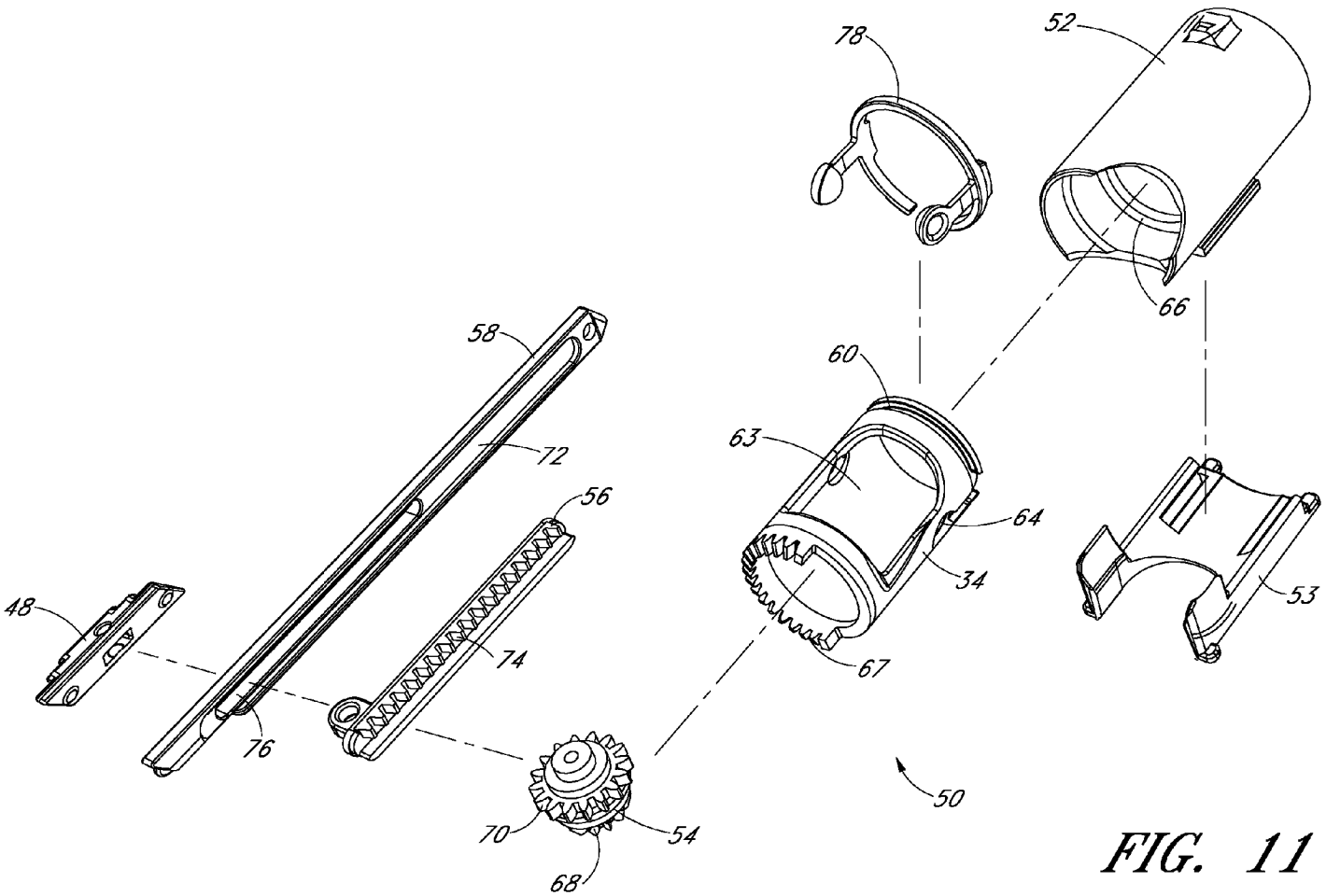
FIG. 11 is an exploded perspective view of the feed system which comprises a rack and pinion for rotating a sleeve between the first and second positions.
Figure 13:
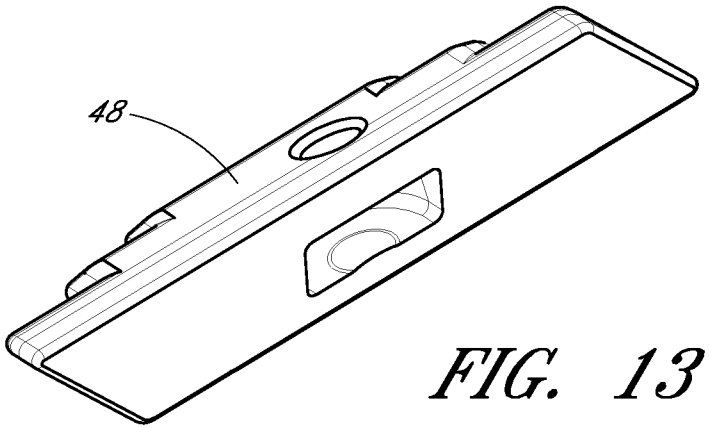
FIG. 13 is another perspective view of the lever from FIG. 12.
Figure 12:
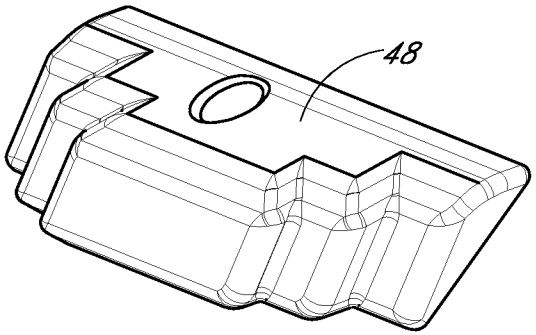
FIG. 12 is a perspective view of the lever for a user to move the sleeve for receiving paintballs between the first and second positions.

FIG. 11 is an exploded perspective view of the feed system 46. The feed system 46 includes a lever 48 and a drive system 50. At least a portion of the lever 48 is accessible by the user. FIG. 12 is a perspective view of the lever 48. FIG. 13 is another perspective view of the lever 48 from FIG. 12. The lever 48 is configured for a user to move the sleeve 34 and its opening 63 for receiving paintballs into the breech 32 between the first position and the second position. As the lever 48 is moved from the back position illustrated in FIG. 9 to the front position illustrated in FIG. 10, the drive system 50 rotates the sleeve 34 and the opening 63 from the second position to the first position. In the illustrated embodiment of the marker 20, the opening 63 is located near the right side of the marker 20 when in the second position. For example, the opening 63 could be located at the 2 o'clock position when in the second position. The opening 63 is located near the bottom side of the marker 20 when in the first position. For example, the opening 63 could be located at the 6 o'clock position when in the first position. In other words, the opening 63 is aligned with the opening 35(*a*) to receive bottom fed paintballs from a magazine when in the first position. When in the second position, the opening 63 is aligned with the opening 35(*b*) to receive paintballs from a hopper. The lever 48 is coupled to the drive system 50 to move the opening 63 between the first and second positions.

Figure 14:
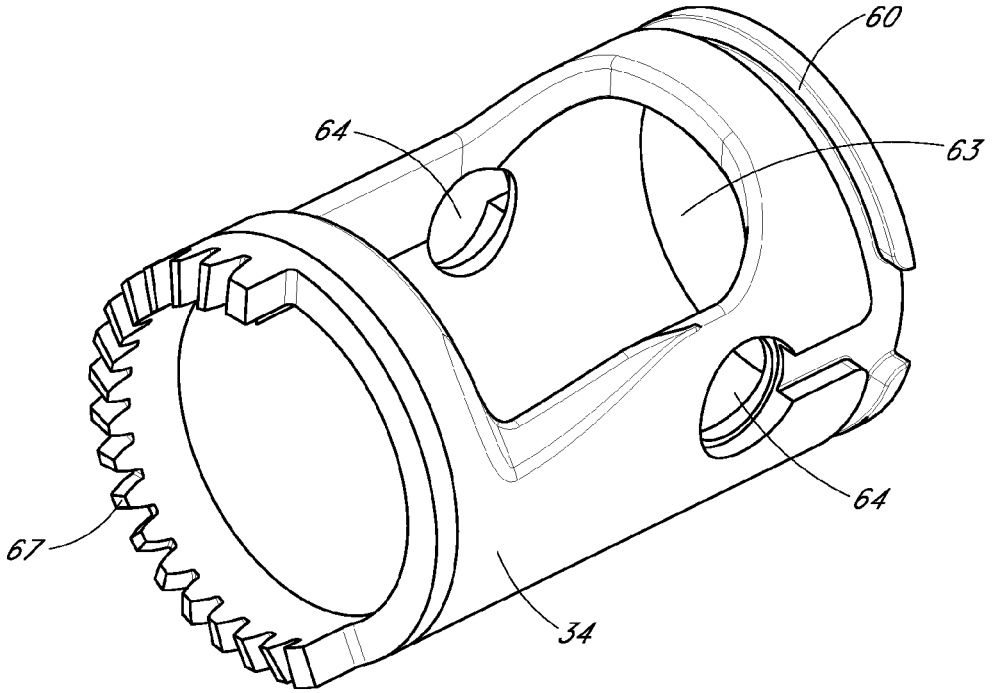
FIG. 14 is a perspective view of the sleeve which can be aligned with the first and second openings.
Figure 15:
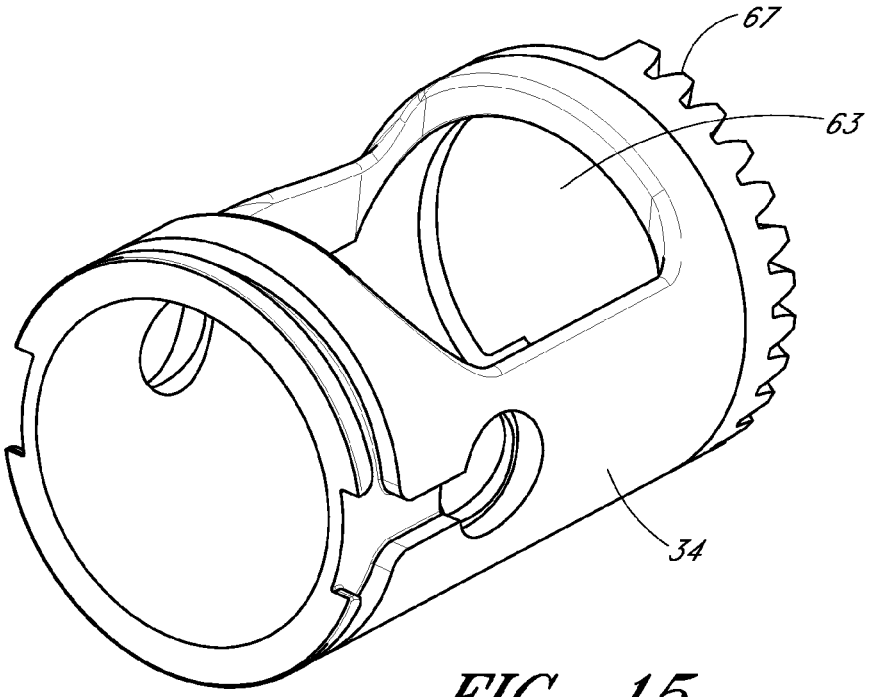
FIG. 15 is an opposite end perspective view of the sleeve.

In the illustrated embodiment, the drive system 50 comprises a sleeve 34. The sleeve 34 includes the opening 63 for paintballs to pass therethrough. In this way, the paintball loading chamber or breech 32 is defined at least in part by the sleeve 34. FIG. 14 is a perspective view of the sleeve 34. FIG. 15 is an opposite end perspective view of the sleeve 34. A wall of the sleeve 34 defines the opening 63 through which paintballs enter the breech or paintball loading chamber 32. Of course the opening 63 need not have a continuous outer perimeter. For example, the opening 63 could be defined by a perimeter wall which opens to one of the distal or proximal ends of the sleeve 34. In this way, the opening 63 would have a c-shape that is open on one side.

When the sleeve 34 is rotated, the opening 63 in the sleeve 34 moves between at least two different radial locations about the longitudinal axis of the barrel 22. In the illustrated embodiment, the sleeve 34 moves the opening 63 between the 2 and 6 o'clock positions. Of course the invention is not limited to rotating the sleeve 34 between the 2 and 6 o'clock positions or to only rotating between two positions. Further, in certain embodiments, the sleeve 34 slides rather than rotates between the at least two positions. In certain other embodiments, the sleeve 34 slides and rotates between the at least two positions.

The sleeve 34 may include one or more grooves 60 for receiving portions of paintball detents 78 or other components. For example, one or more wires for connecting the transmitter and receiver of the anti-chop eye system could be disposed in the grooves 60. The sleeve 34 may further include one or more openings 64 for receiving the paintball detents 78 on either side of the breech 32. The ball detents 78 may be made of rubber or other like material. The ball detents 78 retain the paintballs in position between a transmitter and a receiver prior to the firing of the pneumatic paintball marker 20. The ball detents 78 inhibit the paintball positioned within the breech 32 from rolling down the breech and out of the barrel 22. The ball detents 78 may also inhibit "double feeding" of paintballs.

A rear portion of the sleeve 34 includes a series of teeth 67 configured to be driven by the drive system 50. The series of teeth 67 span more than 180 degrees about the circumference of the sleeve 34. Of course the series of teeth 67 need not be located on the rear portion of the sleeve 34 and could be located on front or middle portions of the sleeve 34. Further, the span of the teeth 67 along the circumference of the sleeve 34 can be more or less than 180 degrees depending on, for example, the angular distance between the openings 35(*a*), 35(*b*).

Figure 16B:
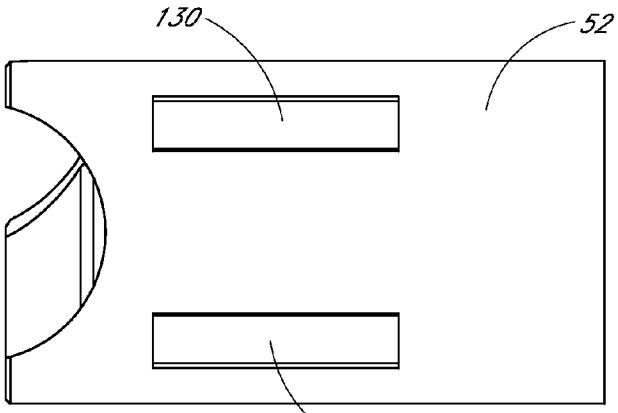
FIG. 16B is a bottom view of the receiver from FIG. 16A showing a plurality of tongues.
Figure 16A:
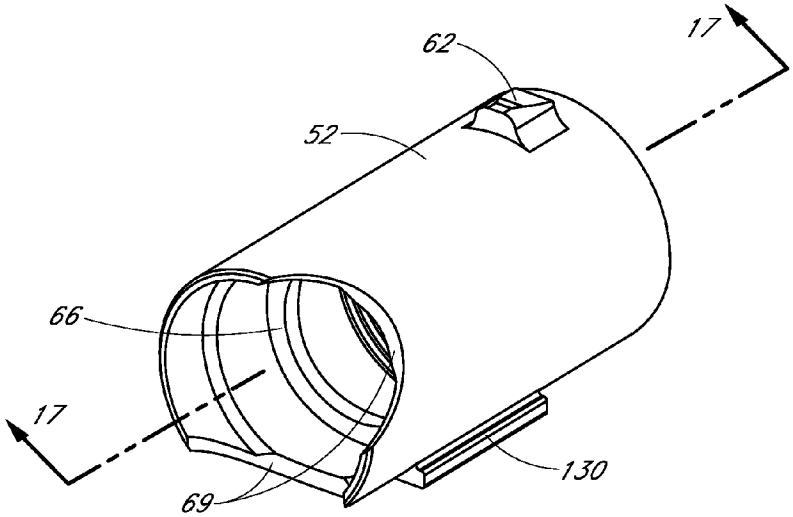
FIG. 16A is a perspective view of the receiver from FIG. 11.

The drive system 50 further includes a receiver 52, a support 53, a pinion 54, and a rack 56 for rotating the sleeve 34 between the first and second positions. FIG. 16A is a perspective view of the receiver 52 from FIG. 11. FIG. 16B is a bottom view of the receiver 52 from FIG. 16A showing a plurality of tongues 130 for engaging with the support 53. The tongues 130 are configured to slidingly engage with a plurality of guides 132 on the support 53.

Figure 17:
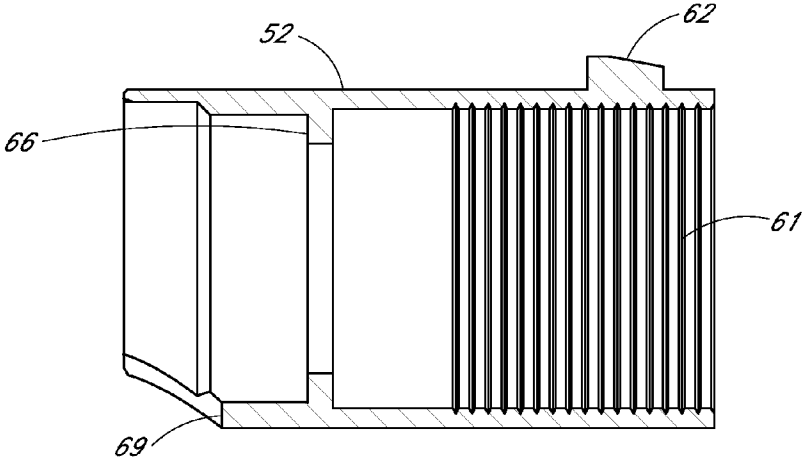
FIG. 17 is a cross-section through the center of the receiver from FIG. 16A showing a scalloped rear opening for engaging with the sleeve.

FIG. 17 is a cross-section through the center of the receiver 52 from FIG. 16A showing a plurality of concave recesses 69. One of the recesses 69 aligns with the opening 63 when the sleeve 34 is rotated to the first position (see FIG. 8B) and the other recess 69 aligns with the opening 63 when the sleeve 34 is rotated to the second position (see FIG. 9). In this way, the recesses 69 define at least a portion of the passageway between the openings 35(*a*), 35(*b*) and the breech 32.

The sleeve 34 and the receiver 52 are mechanically coupled together utilizing one or more grooves, notches, threads, and or other types of coupling structures known in the art. For example, a front portion of the sleeve 34 can be coupled to the receiver 52 to allow the sleeve 34 to rotate relative to the receiver 52. In the illustrated embodiment, a front portion of the sleeve 34 rotates against a shoulder 66 within the receiver 52. A front portion of the receiver 52 includes one or more threads 61 for engaging with the barrel 22. In certain embodiments, the outer circumference of the receiver 52 further includes one or more protrusions 62 configured to slidingly engage with one or more grooves 41 on the inside of the marker 20 (see FIG. 8B) to allow the user to slide the barrel 22 and receiver 52 slightly forward. When slid forward, the receiver 52 does not overlap the sleeve 34 and the tongues 130 on the receiver 52 disengage from the plurality of guides 132 on the support 53 to facilitate removal of the sleeve 34 from the marker 20. In certain embodiments, the outer circumference of the sleeve 34 further includes one or more grooves configured to receive a protrusion on the inside diameter of the receiver 52 to guide the rotation of the sleeve 34 within the receiver 52.

Figure 18:
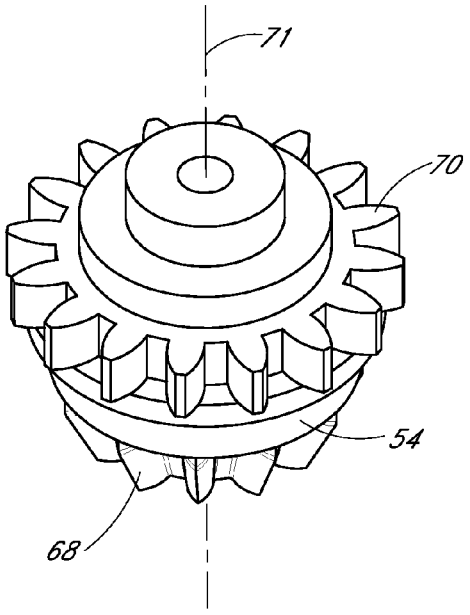
FIG. 18 is a perspective view of the pinion which engages with both the rack and the sleeve.

FIG. 18 is a perspective view of the pinion 54. The pinion 54 is configured to rotate about an axis 71. The pinion 54 includes a first series of teeth 68 and a second series of teeth 70 on opposite ends of the axis 71. The first and second series of teeth 68, 70 share the same axis 71 of rotation. The pinion 54 is configured to engage with both the rack 56 and the sleeve 34.

Figure 19:
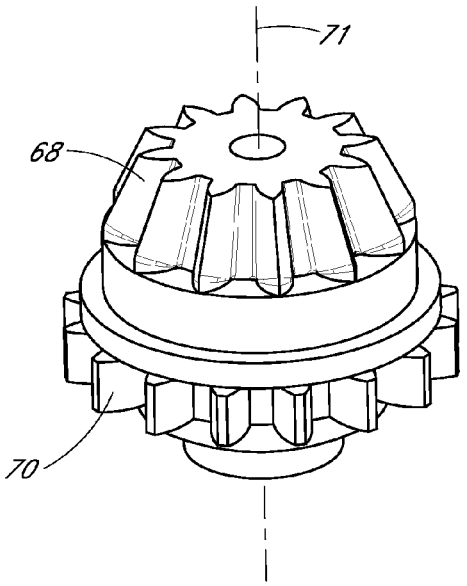
FIG. 19 is another perspective view of the pinion from FIG. 18.

FIG. 19 is another perspective view of the pinion 54 from FIG. 18. The first series of teeth 68 on the pinion 54 are configured to engage with the series of teeth 67 on the rear portion of the sleeve 34. The second series of teeth 70 on the pinion 54 are configured to engage with the rack 56. The numbers of teeth on the first and second series of teeth 68, 70 can be selected to increase or decrease the speed or range of rotation of the sleeve 34 relative to the rack 56.

Figure 20:
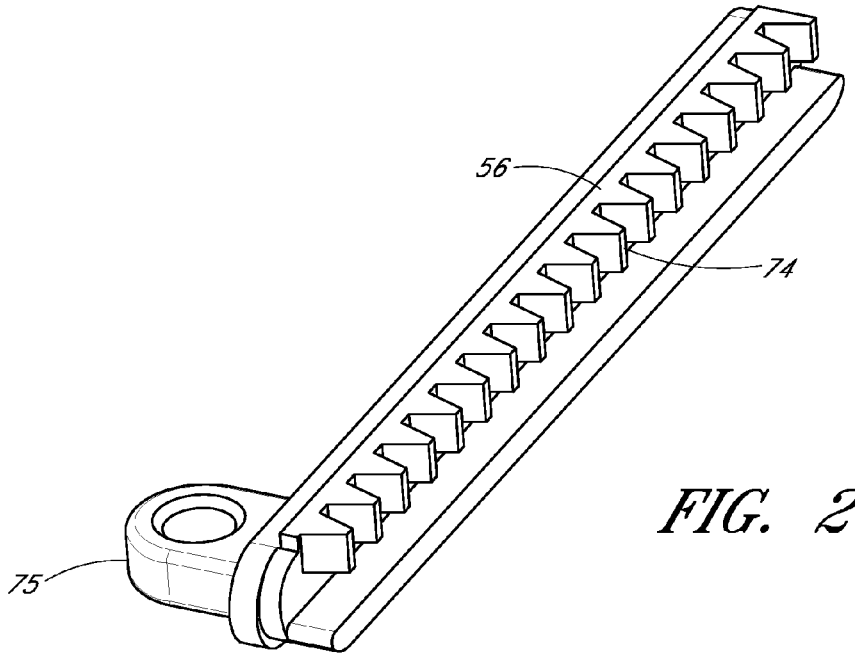
FIG. 20 is a perspective view of the rack showing a series of teeth for engaging with the pinion.
Figure 22:
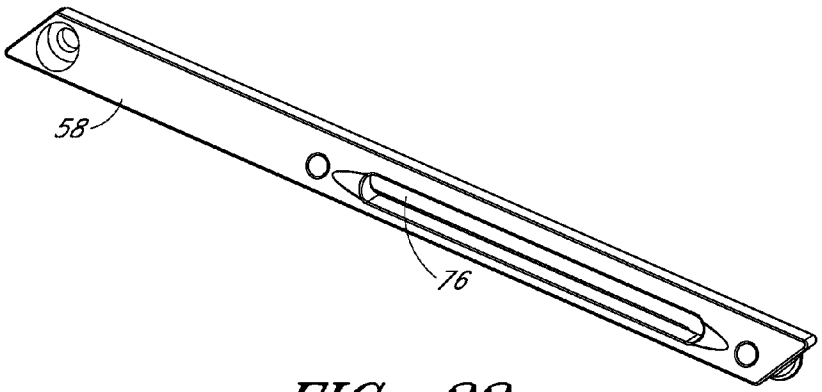
FIG. 22 is an opposite end perspective view of the guide.
Figure 21:
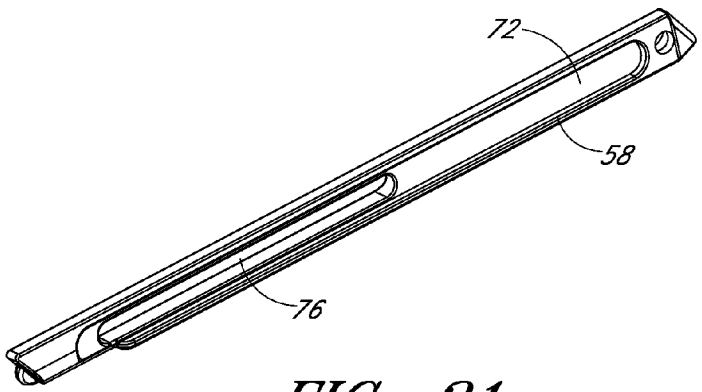
FIG. 21 is a perspective view of a guide having a slot for slidingly receiving the rack.

FIG. 20 is a perspective view of the rack 56. The rack 56 comprises a series of teeth 74 for engaging with the pinion 54 and an ear 75. FIG. 21 is a perspective view of a guide 58 having a slot 72 for slidingly receiving the rack 56. FIG. 22 is an opposite end perspective view of the guide 58. The rack 56 is disposed within the slot 72 in the guide 58. The series of teeth 74 on the rack 56 are disposed so as to engage with the second series of teeth 70 on the pinion 54.

The guide 58 further includes a passage 76 for the ear 75 on the rack 56 to extend through the guide 58 and engage the lever 48. In this way, the lever 48 is engaged with the rack 56 so that the lever 48 and the rack 56 move in unison when a user slides the lever 48. For example, when a user slides the lever 48 in the forward or backwards directions, the rack 56 slides in the same direction in the slot 72. As the rack 56 slides, the series of teeth 74 rotates the pinion 54 via the second series of teeth 70. The rotation of the pinion 54 drives the series of teeth 67 via the first series of teeth 68 which rotates the sleeve 34 about the longitudinal axis of the barrel 22.

Figure 23:
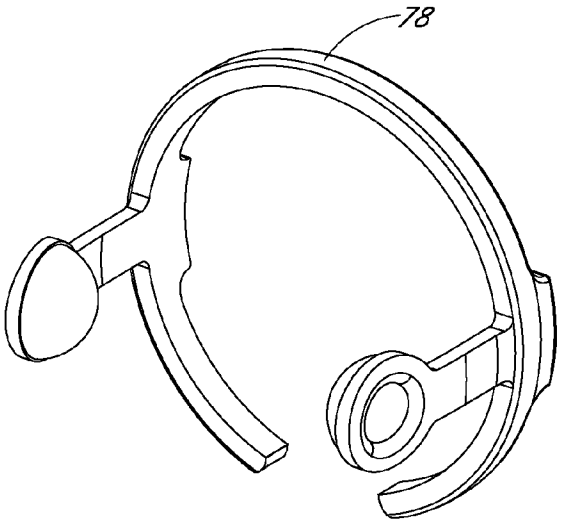
FIG. 23 is a perspective view of paintball detents for engaging with the sleeve.

FIG. 23 is a perspective view of paintball detents 78 for engaging with the sleeve 34. Portions of the detents 78 fit within the one or more openings 64 in the sleeve 34.

Figure 24:
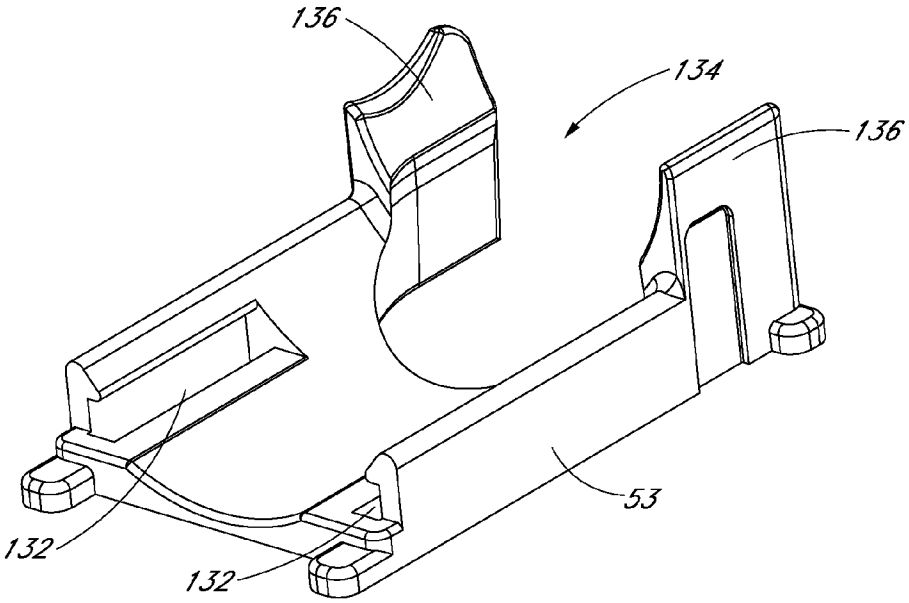
FIG. 24 is a perspective view of a support for the sleeve.

FIG. 24 is a perspective view of a support 53 for the sleeve 34. The support 53 comprises a plurality of guides 132 for slidingly engaging with the tongues 130 on the receiver 52 as is illustrated in FIGS. 9 and 10. The support 53 further comprises a channel 134 defined between upstanding walls 136 of the support 53. The channel 134 receives a portion of the sleeve 34. When disposed within the channel 134, the sleeve 34 is free to rotate relative to the support 53.

Figure 25A:
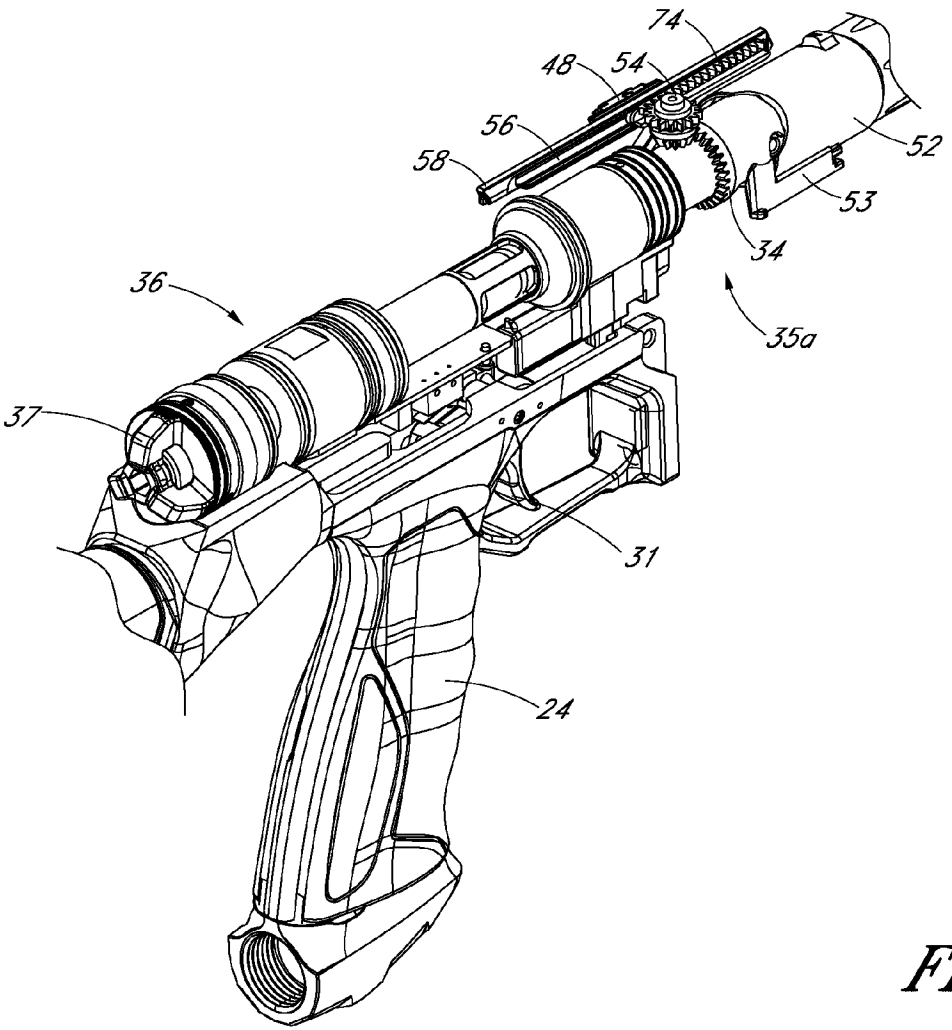
FIG. 25A is a partial perspective view of the marker with the feed system in the first position to receive paintballs through the opening in the bottom of the marker.
Figure 25B:
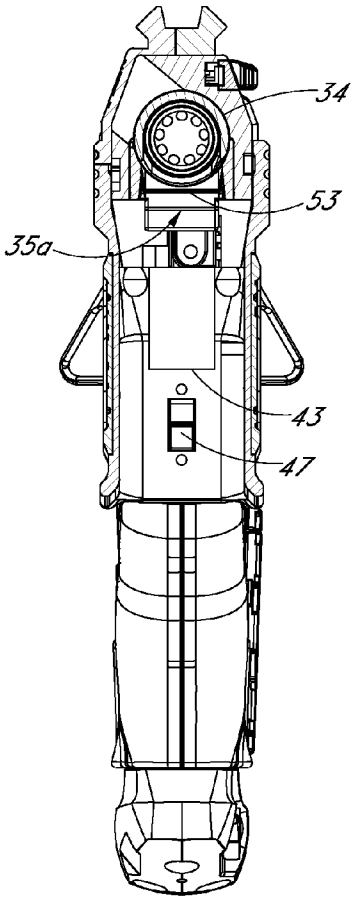
FIG. 25B is a cross-section through the marker of FIG. 2 with the feed system in the first position to receive paintballs through the opening in the bottom of the marker.

FIG. 25A is a partial perspective view of the marker 20 with the feed system 46 in the first position to receive paintballs through the opening 35(*a*) in the bottom of the marker 20. FIG. 25B is a cross-section through the marker 20 of FIG. 2 with the feed system 46 in the first position to receive paintballs through the opening 35(*a*) in the bottom of the marker 20. As illustrated in FIG. 25B, the marker 20 further includes a ridge 43 and lock 47 disposed on the inside of the receptacle 39. The ridge 43 is positioned in the receptacle 39 and can have a generally raised rectangular shape. Of course the ridge 43 is not limited to a rectangular shape and can have other shapes.

A bottom edge of the ridge 43 is disposed so as to catch a door on the magazine 90 (see FIG. 28) when the magazine 90 is partially inserted into the receptacle 39. The ridge 43 is configured to catch the door when the magazine 90 is rotated so that the door is closer to the rear of the marker 20 than the other door in the magazine 90. When the magazine 90 is rotated so that the door is closer to the rear of the marker 20 than the other door, a tab on the door is caught by the same ridge 43.

The lock 47 on the marker 20 engages with a recess in the magazine 90 to maintain the magazine 90 in the fully seated position. In the illustrated embodiment, the lock 47 comprises a pivoting hook which is biased towards an extended position where the hook slightly projects into the receptacle 39. As the magazine 90 slides against the inner wall of the receptacle 39, the magazine 90 forces the hook to retract into the wall of the receptacle 39. When the magazine 90 reaches the fully seated position, the hook of the lock 47 is aligned with the recess and returns to the extended position. When in the extended position, the lock 47 is engaged with the recess and the magazine 90 cannot be removed from the receptacle 39. To remove the magazine 90 from the receptacle 39, a user presses a button.

Figure 26B:
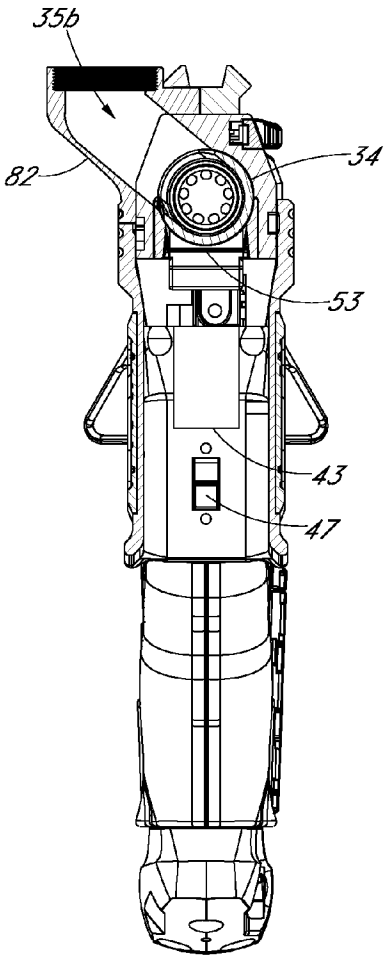
FIG. 26B is a cross-section through the marker of FIG. 2 with the feed system in the second position to receive paintballs through the opening in the side of the marker.
Figure 26A:
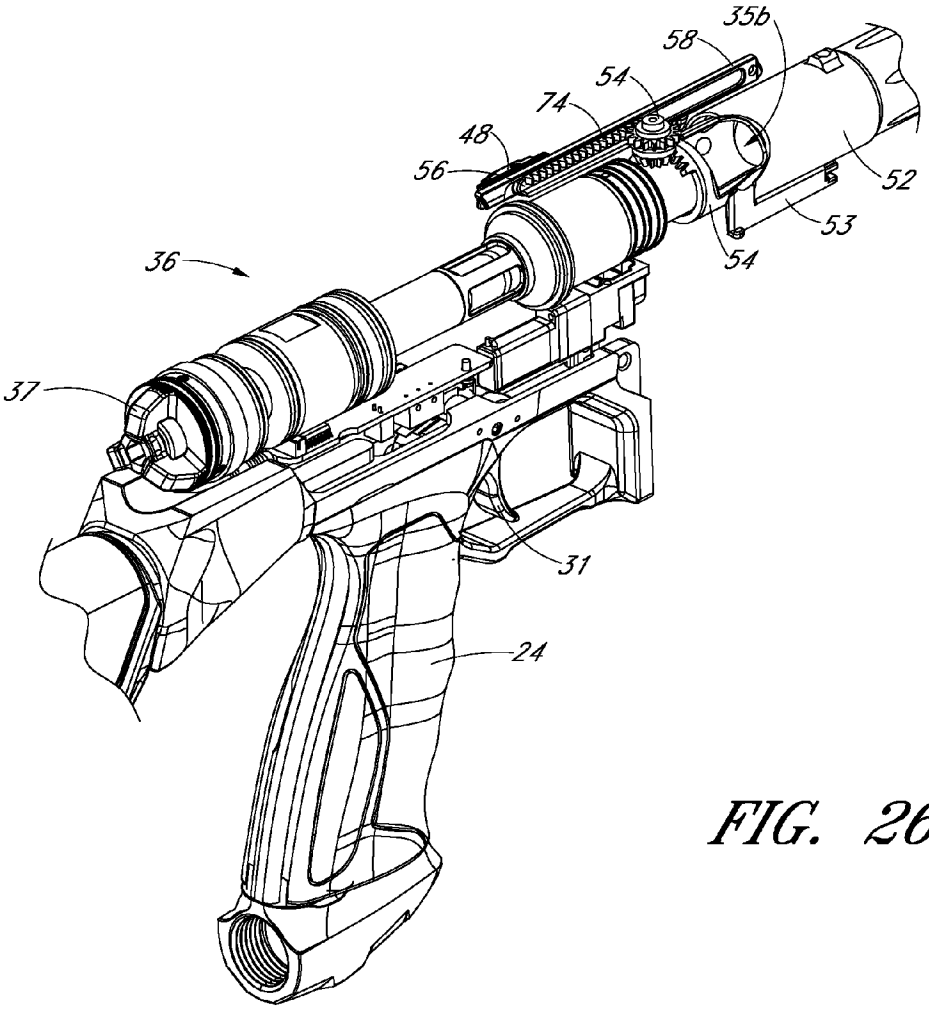
FIG. 26A is a partial perspective view of the marker from FIG. 25A after the feed system has been rotated to the second position to receive paintballs through the opening in the side of the marker.

FIG. 26A is a partial perspective view of the marker 20 from FIG. 25A after the feed system 46 has been rotated to the second position to receive paintballs through the opening 35(*b*) in the side of the marker 20. Similarly, FIG. 26B is a cross-section through the marker 20 of FIG. 2 with the feed system 46 in the second position to receive paintballs through the opening 35(*b*) in the side of the marker 20.

Figure 27:
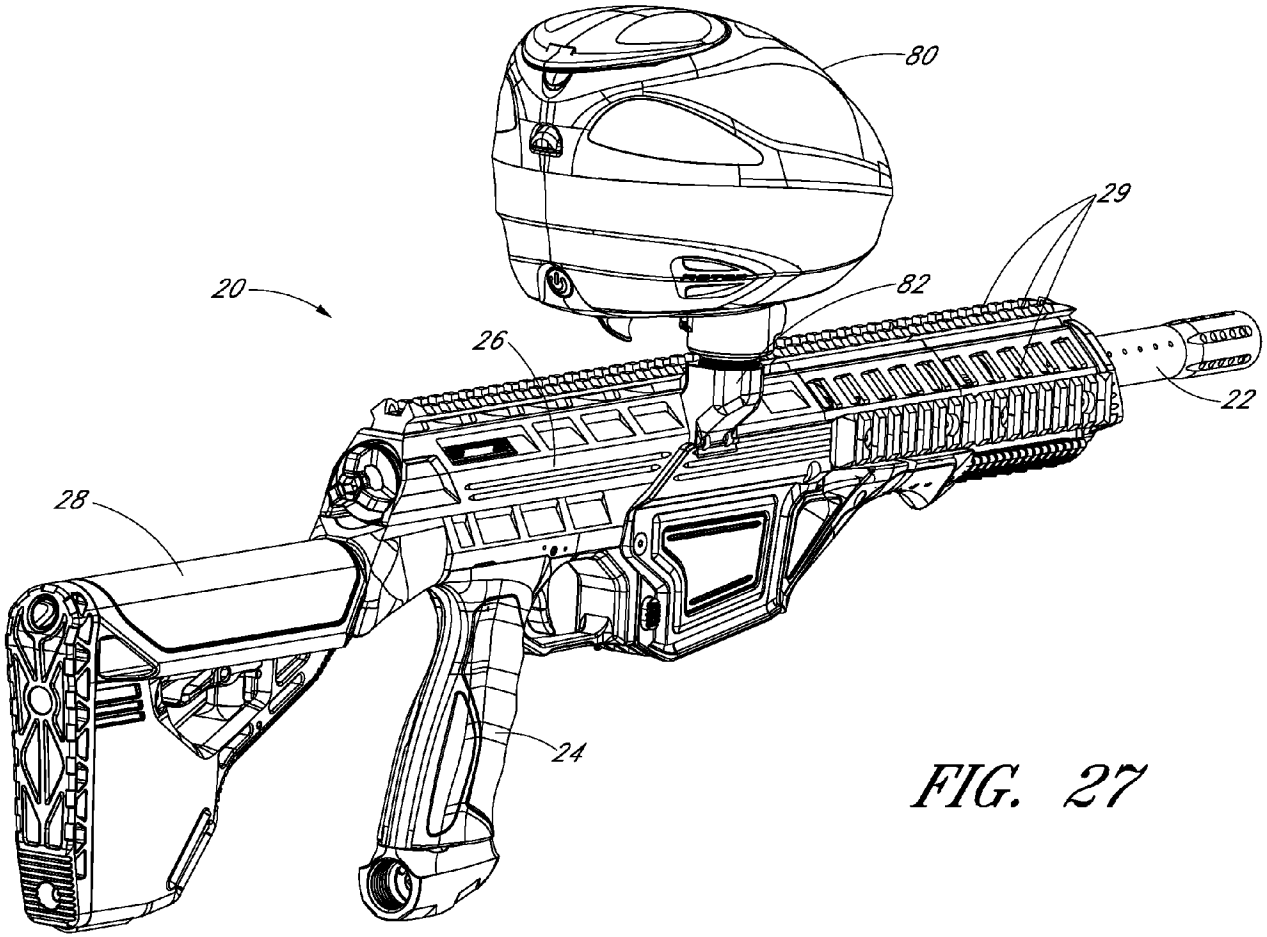
FIG. 27 is a perspective view of the marker with a hopper attached to allow paintballs from the hopper to enter the breech through the opening in the side of the marker.

FIG. 27 is a perspective view of the marker 20 with a hopper 80 attached to allow paintballs from the hopper 80 to enter the breech through the second opening 35(*b*) in the side of the marker 20. After removing the plate 33 (See FIG. 2) to expose the second opening 35(*b*), an outlet of a feedneck supporting member 82 is bolted around the second opening 35(*b*). The feedneck supporting member 82 is configured to receive a boss formed on the hopper or loader 80. In some embodiments, the feedneck 82 on the marker 20 can have a tightening mechanism configured to constrict the feedneck 82 around the boss formed on the hopper or loader 80. For example, a clamp mechanism or a collar and lever mechanism may be employed to secure the hopper 80 to the marker 20. In this assembled configuration, the balls fed by the hopper 80 through the boss can enter the marker 20 through the feedneck 82 formed on the marker 20, to be ultimately shot by the marker 20 at the desired target. In this way, paintballs in the hopper 80 are fed to the breech 32 via the second opening 35(*b*). An exemplary hopper 80 for use with the marker 20 is also fully described in U.S. Pat. No. 8,047,190, which is expressly incorporated by reference as if fully set forth herein.

Figure 28:
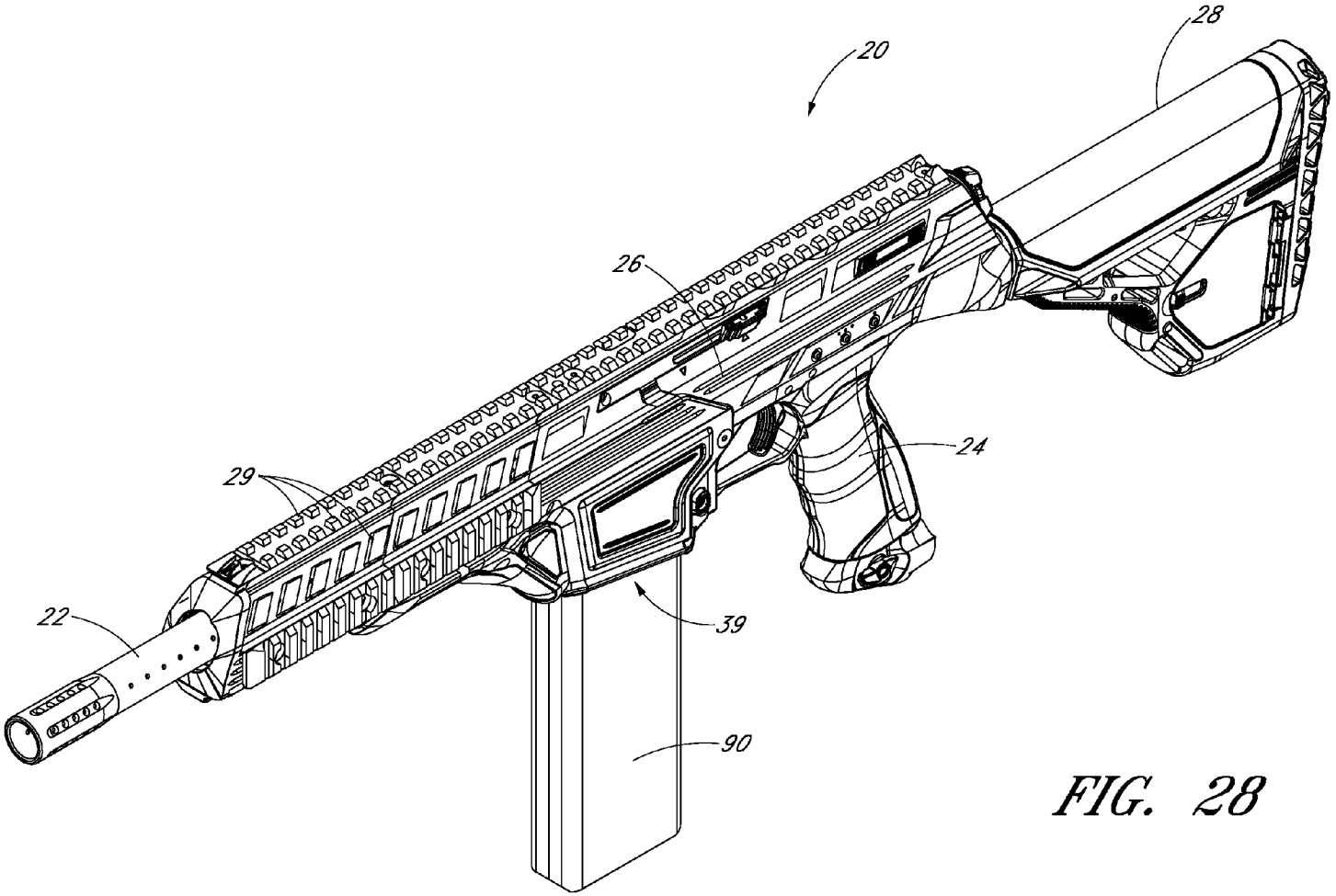
FIG. 28 is an opposite side perspective view of the marker with a magazine attached to allow paintballs from the magazine to enter the breech through the opening in the bottom of the marker.

FIG. 28 is an opposite side perspective view of the marker 20 with a magazine 90 attached to allow paintballs from the magazine 90 to enter the breech 32 through the first opening 35(*a*) in the bottom of the marker 20. The magazine 90 is engaged with the receptacle 39. The receptacle 39 further includes a lip or ridge 43 (most clearly shown in FIG. 8A) positioned so as to catch a door on the magazine 90 when the magazine 90 is partially inserted into the receptacle 39. As the magazine 90 is inserted further into the receptacle 39 and eventually is fully seated in the receptacle 39, the lip or ridge 43 slides the door open to allow paintballs to pass unencumbered from the magazine 90 to the marker 20. In this way, the feed rate of paintballs is controlled by the marker 20. During the time the magazine 90 is fully seated in the receptacle 39, the door in the magazine 90 stays open. As the magazine 90 is being removed from the receptacle 39, the door on the magazine 90 moves away from the lip or ridge 43 in the receptacle 39 allowing the door to slide towards a closed position so that paintballs remaining in the magazine 90 are not ejected from the magazine 90. Preferably the door is biased towards the closed position via spring. An exemplary magazine 90 for use with the marker 20 is also fully described in concurrently filed commonly owned U.S. Patent Application entitled "Magazine", which is expressly incorporated by reference as if fully set forth herein. Although FIGS. 27 and 28 illustrate the marker 20 attached to either the hopper 80 or the magazine 90, embodiments of the marker 20 can be attached to both a hopper 80 and a magazine 90 at the same time. The user slides the lever 48 in the forward or backwards directions to rapidly switch between feeding paintballs from the magazine 90 or hopper 80 while both are attached to the marker 20.

Figure 29A:
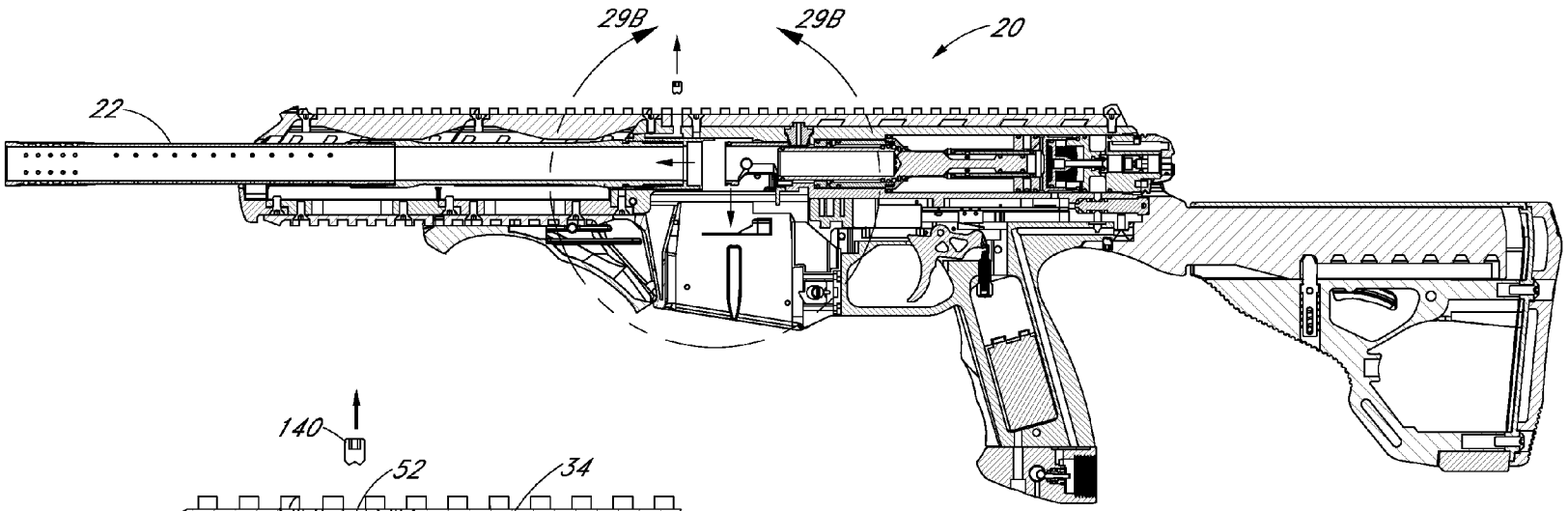
FIG. 29A is a cross-section through the marker of FIG. 2 with the barrel and receiver slid slightly in a forward direction and the support partially removed from below the sleeve.
Figure 29B:
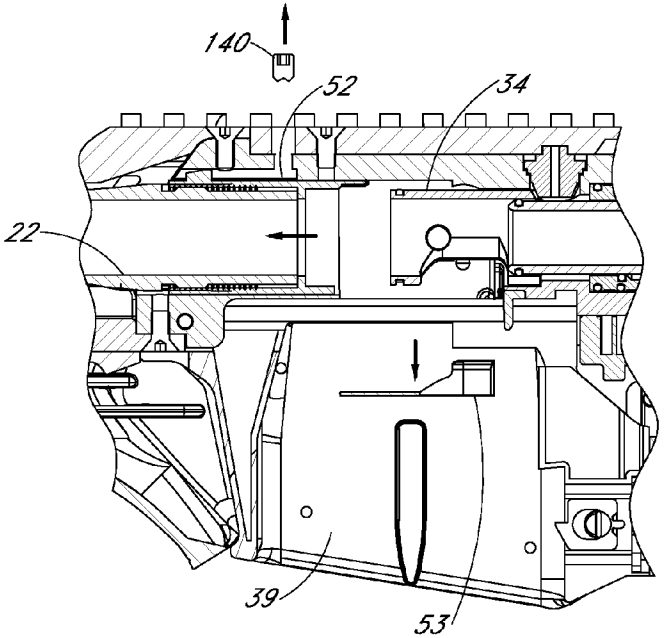
FIG. 29B is an enlarged view of the marker from FIG. 29A.

FIG. 29A is a cross-section through the marker 20 of FIG. 2 with the barrel 22 and receiver 52 slid slightly in a forward direction and the support 53 partially removed from below the sleeve 34. FIG. 29B is an enlarged view of the marker 20 from FIG. 29A. To remove the sleeve 34 from the marker 20 for cleaning the user retracts set screw 140. With the set screw 140 retracted, the user slides the barrel 22 and the receiver 52 forward as is illustrated in FIG. 29B. The barrel 22 and the receiver 52 are slid forward enough so that the receiver 52 is no longer overlapping the sleeve 34. When slid forward, the tongues 130 on the receiver 52 disengage from the plurality of guides 132 on the support 53. The user removes the support 53 from the marker 20 as shown in FIG. 29B via the receptacle 39. With the support 53 removed, the user is able to remove the sleeve 34 also via the receptacle 39. The user is able to clean the sleeve 34 and other adjacent components in the marker 20 without disassembling the marker 20 including removing the rails 29 from the marker 20.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A pneumatic paintball marker configured to fire a paintball, the pneumatic paintball marker comprising: a body member in the shape of a rifle and having a longitudinal bore; a barrel extending from said body member and in flow communication with the longitudinal bore; and a sleeve disposed in the longitudinal bore of the body member and defining a breech, a side wall of the sleeve having an opening for paintballs to enter the breech, the opening being rotatable relative to the body member between at least a first position and a second position wherein the opening is configured to receive paintballs from a first paintball container when in the first position and from a second paintball container when in the second position.

2. The marker of claim 1 further comprising a buttstock, the buttstock being coupled to the body member.

3. The marker of claim 1 further comprising a bolt assembly disposed in at least a portion of the longitudinal bore.

4. The marker of claim 1 further comprising a lever, wherein movement of the lever rotates the opening between the first and second positions.

5. The marker of claim 1 further comprising a receiver, the receiver being disposed in the longitudinal bore of the body member between the barrel and the sleeve.

6. The marker of claim 5, wherein the receiver comprises a thread for engaging with the barrel and a shoulder for engaging with the sleeve.

7. The marker of claim 5, wherein the receiver comprises at least one scalloped region, the scalloped region coinciding with at least a portion of a perimeter of the opening when the opening is in at least one of the first and second positions.

8. The marker of claim 1 further comprising a pinion, wherein the sleeve comprises one or more teeth disposed so as to engage the pinion.

9. The marker of claim 8 further comprising a rack, wherein the rack is disposed so as to engage with the pinion.

10. The marker of claim 1 further comprising a bolt assembly disposed in at least a portion of the longitudinal bore.

11. The marker of claim 1 further comprising a rail attached to the body member.

12. The marker of claim 4, wherein the lever is disposed on an outer surface of the body member.

13. The marker of claim 4, wherein the sleeve comprises a series of teeth which are driven by movement of the lever.

* * * * *